US011554369B2

(12) United States Patent
Branch et al.

(10) Patent No.: US 11,554,369 B2
(45) Date of Patent: Jan. 17, 2023

(54) MICROFLUIDIC PACKAGE AND METHOD OF MAKING THE SAME

(71) Applicant: National Technology & Engineering Solutions of Sandia, LLC, Albuquerque, NM (US)

(72) Inventors: Darren W. Branch, Albuquerque, NM (US); Philip R. Miller, Albuquerque, NM (US); Thayne L. Edwards, Bend, OR (US); David R. Wheeler, Albuquerque, NM (US)

(73) Assignee: National Technology & Engineering Solutions of Sandia, LLC, Albuquerque, NM (US)

( * ) Notice: Subject to any disclaimer, the term of this patent is extended or adjusted under 35 U.S.C. 154(b) by 315 days.

(21) Appl. No.: 16/884,581

(22) Filed: May 27, 2020

(65) Prior Publication Data

US 2020/0316596 A1 Oct. 8, 2020

Related U.S. Application Data

(62) Division of application No. 15/415,675, filed on Jan. 25, 2017, now Pat. No. 10,717,079.

(60) Provisional application No. 62/288,731, filed on Jan. 29, 2016.

(51) Int. Cl.
*B01L 3/00* (2006.01)

(52) U.S. Cl.
CPC ... *B01L 3/502715* (2013.01); *B01L 3/502707* (2013.01); *B01L 2200/0689* (2013.01); *B01L 2200/12* (2013.01); *B01L 2300/04* (2013.01); *B01L 2300/0816* (2013.01); *B01L 2300/0887* (2013.01); *B01L 2300/16* (2013.01)

(58) Field of Classification Search
CPC ..... B01L 3/502715; B01L 3/502707; B01L 2200/0689; B01L 2200/12; B01L 2300/04; B01L 2300/0816; B01L 2300/0887; B01L 2300/16
See application file for complete search history.

(56) References Cited

U.S. PATENT DOCUMENTS

| | | | |
|---|---|---|---|
| 7,878,063 | B1 | 2/2011 | Cular et al. |
| 8,669,688 | B1 | 3/2014 | Branch |
| 8,709,791 | B2 | 4/2014 | Larson et al. |
| 9,096,823 | B1 | 8/2015 | Branch et al. |
| 9,512,421 | B1 | 12/2016 | Branch et al. |
| 2002/0014306 | A1 | 2/2002 | Virtanen |
| 2005/0284213 | A1 | 12/2005 | Karp et al. |
| 2006/0220223 | A1 | 10/2006 | Lu et al. |

(Continued)

OTHER PUBLICATIONS

Banuls, "Chemical surface modifications for the development of silicon-based label-free integrated optical (IO) biosensors: A review", Analytica Chimica Acta 2013; 777: 1-16.

(Continued)

*Primary Examiner* — Samuel P Siefke
(74) *Attorney, Agent, or Firm* — Calfee, Halter & Griswold LLP; Madelynne J. Farber; Samantha Updegraff

(57) ABSTRACT

The present invention relates to encapsulated microfluidic packages and methods thereof. In particular embodiments, the package includes a device, a cradle configured to support the device, and a lid having a bonding surface configured to provide a fluidic seal between itself and the device and/or cradle. Other package configurations, as well as methods for making such fluidic seals, are described herein.

20 Claims, 20 Drawing Sheets

(56) References Cited

U.S. PATENT DOCUMENTS

| | | | |
|---|---|---|---|
| 2006/0237080 | A1 | 10/2006 | Jon et al. |
| 2008/0245135 | A1 | 10/2008 | Aubin et al. |
| 2010/0112569 | A1 | 5/2010 | Bar-Ziv et al. |
| 2015/0198782 | A1 | 7/2015 | Ting et al. |

OTHER PUBLICATIONS

Haensch, "Chemical modification of self-assembled silane based monolayers by surface reactions", Chemical Society Reviews 2010; 39: 2323-34.

Vandelinder, "Simple, Benign, Aqueous-Based Amination of Polycarbonate Surfaces", 2015, 7(10): 5643-5649.

MICROFLUIDIC PACKAGE AND METHOD OF MAKING THE SAME

CROSS-REFERENCE TO RELATED APPLICATION

This application is a divisional application of parent patent application U.S. patent application Ser. No. 15/415,675, filed Jan. 25, 2017 and entitled "MICROFLUIDIC PACKAGE AND METHOD OF MAKING THE SAME" which claims the benefit of U.S. Provisional Application No. 62/288,731, filed Jan. 29, 2016. The present application claims the priority of its parent application, which is incorporated herein by reference in its entirety for any purpose.

STATEMENT OF GOVERNMENT INTEREST

This invention was made with Government support under contract no. DE-NA0003525 awarded by the U.S. Department of Energy to National Technology & Engineering Solutions of Sandia, LLC. The Government has certain rights in the invention.

FIELD OF THE INVENTION

The present invention relates to encapsulated microfluidic packages and methods thereof. In particular embodiments, the package includes a device, a cradle configured to support the device, and a lid having a bonding surface configured to provide a fluidic seal between itself and the device and/or cradle. Other package configurations, as well as methods for making such fluidic seals, are described herein.

BACKGROUND OF THE INVENTION

Fluidic systems can provide complicated routines to manipulate and analyze small volumes of fluid. Such systems can have numerous fluidic features imparted by lithography and other fabrication techniques, as well as selective and/or specific analyte detection imparted by biological or chemical capture probes. Fabrication steps can include use of chemicals, etchants, oxidants, etc., that are incompatible with capture probes. Thus, there is a need for additional methods for fabricating fluidic packages in the presence of sensitive biological or chemical probes.

SUMMARY OF THE INVENTION

Accordingly, the present invention relates, in part, to encapsulated fluidic packages having a fluidic seal formed under mild conditions, e.g., low temperature conditions, low pressure conditions, and/or minimal bonding times, etc. The fluidic seal is formed between reactive groups, which can be instilled on various bonding surfaces of a device, a cradle, and/or a lid, as described herein.

In a first aspect, the present invention relates to an encapsulated microfluidic package including: a device including an active area and an inactive area (e.g., where the active area includes one or more capture probes; a cradle configured to support the device); a first bonding surface disposed on a portion of a surface of the cradle, where the first bonding surface includes a first reactive group; a lid including a recess, an upper surface, and a second bonding surface disposed on a lower surface of the lid, where the recess is configured to be disposed above the active area and where the second bonding surface includes a second reactive group configured to react with the first reactive group; and a first fluidic seal between the first and second bonding surfaces, where the first fluidic seal results from a reaction between the first and second reactive groups and where the first fluidic seal is formed in the presence of the one or more capture probes. In some embodiments, the second reactive group includes an amino group and/or a thio group (e.g., a thioalkoxy group or a thiol group). In other embodiments, the first reactive group includes an amido group and/or an epoxide group.

In some embodiments, the second bonding surface is disposed above the first bonding surface and disposed above a portion of a surface of the inactive area.

In further embodiments, the package includes a third bonding surface disposed on the portion of the surface of the inactive area, where the third bonding surface includes a third reactive group configured to react with the second reactive group. In some embodiments, the fluidic seal results from a reaction between the first and second reactive groups and a reaction between the second and third reactive groups.

In some embodiments, the lid includes a first polymer, the cradle includes a second polymer, and the first and second polymers are same or different (e.g., any polymer described herein).

In some embodiments, the first fluidic seal includes a covalent bond between the first and second reactive groups.

In some embodiments, the lid includes a cover and a plurality of pillars. In further embodiments, the second bonding surface is disposed on a surface of at least one of the plurality of pillars.

In further embodiments, the package includes a protected surface disposed on a portion of the surface of the inactive area. In some embodiments, the protected surface includes a protecting group (e.g., an aryl group, a poly(ethylene glycol) group, a polymer, etc.) configured to reduce binding of a chemical or biochemical moiety to the protected surface.

In further embodiments, the package includes an intermediate layer including a further binding surface, where the intermediate layer is configured to be disposed above the upper surface of the lid. In some embodiments, the upper surface of the lid includes the second reactive group, and the further binding surface includes a further reactive group configured to react with the second reactive group of the upper surface. In some embodiments, the package includes a second fluidic seal disposed between the intermediate layer and the upper surface of the lid.

In some embodiments, the intermediate layer further includes one or more inlets, vias, or chambers configured to provide fluidic communication with the recess.

In a second aspect, the present invention features an encapsulated microfluidic package including: a device including an active area and an inactive area (e.g., where the active area includes one or more capture probes); a first bonding surface disposed on a portion of a surface of the inactive area, where the first bonding surface includes a first reactive group; a lid including a recess and a second bonding surface, where the second bonding surface includes a second reactive group configured to react with the first reactive group; and a first fluidic seal between the first and second bonding surfaces, where the seal results from a reaction between the first and second reactive groups. In some embodiments, the seal is formed in the presence of the one or more capture probes. In some embodiments, the recess is configured to be disposed above the active area.

In some embodiments, the lid includes a cover and a plurality of pillars, where the second bonding surface is disposed on a surface of at least one of the plurality of pillars. In further embodiments, the plurality of pillars is configured to surround the active area of the device upon forming a seal between the lid and the device. In other embodiments, the plurality of pillars and cover, together, form a recess disposed above the active area of the device.

In a third aspect, the invention features a method of making an encapsulated microfluidic package, the method including: functionalizing a portion of a device to provide a first bonding surface including a first reactive group, where the device includes an active area and an inactive area (e.g., where the active area includes one or more capture probes); functionalizing a lid to provide a second bonding surface including a second reactive group, where the lid includes a recess, an upper surface, and the second bonding surface disposed on a lower surface of the lid, where the second reactive group is configured to react with the first reactive group; and attaching the second bonding surface of the lid to the first bonding surface of the device, thereby forming a first fluidic seal, where the first fluidic seal results from a reaction between the first and second reactive groups. In some embodiments, the first fluidic seal is formed in the presence of the one or more capture probes. In some embodiments, the recess is configured to be disposed above the active area.

In further embodiments, the method includes (e.g., prior to the attaching step): functionalizing the inactive area of the device to provide a protected surface including a protecting group.

In a fourth aspect, the present invention features a method of making an encapsulated microfluidic package, the method including: attaching a device to a cradle, where the device includes an active area and an inactive area (e.g., where the active area includes one or more capture probes); functionalizing a portion of the cradle to provide a first bonding surface including a first reactive group; functionalizing a lid to provide a second bonding surface including a second reactive group, where the second reactive group is configured to react with the first reactive group; and attaching the second bonding surface of the lid to the first bonding surface of the cradle, thereby forming a first fluidic seal, where the first fluidic seal results from a reaction between the first and second reactive groups. In some embodiments, the first fluidic seal is formed in the presence of the one or more capture probes. In other embodiments, the lid includes a recess, an upper surface, and the second bonding surface disposed on a lower surface of the lid, where the recess is configured to be disposed above the active area.

In some embodiments, the method further includes: functionalizing a portion of a device to provide a third bonding surface including a third reactive group, where the third reactive group is configured to react with the second reactive group; and/or functionalizing a portion of the inactive area of the device to provide a protected surface including a protecting group.

In a fifth aspect, the present invention features a method of making an encapsulated microfluidic package, the method including: functionalizing a portion of a device to provide a first bonding surface including a first reactive group, where the device includes an active area and an inactive area; functionalizing a lid to provide a second bonding surface including a second reactive group, where the lid includes a recess, an upper surface, and the second bonding surface disposed on a lower surface of the lid, where the recess is configured to be disposed above the active area, and where the second reactive group is configured to react with the first reactive group; and attaching the second bonding surface of the lid to the first bonding surface of the device, thereby forming a first fluidic seal, where the first fluidic seal results from a reaction between the first and second reactive groups. In some embodiments, the first fluidic seal is formed in the presence of the one or more capture probes.

In some embodiments, the method further includes: optionally functionalizing a portion of the inactive area of the device to provide a protected surface including a protecting group (e.g., where the functionalizing step includes providing a first reactive surface including a further reactive group and then reacting the further reactive group with a protecting group precursor, thereby providing the protected surface including a protecting group disposed on the portion of the inactive area).

In other embodiments, the method further includes: optionally functionalizing an active area of the device to provide a detecting surface (e.g., where the functionalizing step includes providing a second reactive surface including a further reactive group and then reacting the further reactive group with one or more capture probes, thereby providing detecting surface configured to detect one or more analytes).

In a sixth aspect, the present invention features a method of making an encapsulated microfluidic package, the method including: forming at least two pillars on an inactive area of a device, where the at least two pillars surround an active area of the device; functionalizing a portion of each of the at least two pillars to provide a first bonding surface including a first reactive group; functionalizing a cover and/or a lid to provide a second bonding surface including a second reactive group, where the second reactive group is configured to react with the first reactive group; and attaching the second bonding surface of the cover to the first bonding surface of the pillar, thereby providing a lid having a recess disposed above the active area, where the first fluidic seal results from a reaction between the first and second reactive groups. In some embodiments, the first fluidic seal is formed in the presence of the one or more capture probes. In other embodiments, the method includes further forming a first fluidic seal between the cover and the at least two pillars and the device.

In some embodiments, the cover includes an upper surface, and the second bonding surface disposed on a lower surface of the cover.

In a seventh aspect, the present invention features a method of making an encapsulated microfluidic package, the method including: attaching a device to a cradle, where the device includes an active area and an inactive area (e.g., where the active area includes one or more capture probes); functionalizing a portion of the cradle to provide a first bonding surface including a first reactive group; functionalizing a lid to provide a second bonding surface including a second reactive group, where the second reactive group is configured to react with the first reactive group; and functionalizing a portion of the device to provide a third bonding surface including a third reactive group, where the third reactive group is configured to react with the second reactive group; and attaching the second bonding surface of the lid to the first bonding surface of the cradle and/or the third bonding surface of the device, thereby forming a first fluidic seal. In some embodiments, the first fluidic seal results from a reaction between the first and second reactive groups and/or between the second and third reactive groups. In other embodiments, the first fluidic seal is formed in the presence of the one or more capture probes.

In some embodiments, the lid includes a recess, an upper surface, and the second bonding surface disposed on a lower surface of the lid; and the recess is configured to be disposed above the active area.

In an eighth aspect, the present invention features a method of making an encapsulated microfluidic package, the method including: attaching a device to a cradle, where the device includes an active area and an inactive area; forming at least two pillars on the inactive area of a device, where the at least two pillars surround the active area of the device; functionalizing a portion of each of the at least two pillars to provide a first bonding surface including a first reactive group;

functionalizing a cover to provide a second bonding surface including a second reactive group, where the second reactive group is configured to react with the first reactive group; and attaching the second bonding surface of the cover to the first bonding surface of the pillar, thereby providing a lid having a recess disposed above the active area and further forming a first fluidic seal between the cover and the at least two pillars and the device, where the first fluidic seal results from a reaction between the first and second reactive groups. In some embodiments, the cover includes an upper surface and the second bonding surface disposed on a lower surface of the cover.

In other embodiments, the method further includes: functionalizing a portion of the cradle to provide a third bonding surface including a first third group, where the third reactive group is configured to react with the second reactive group of the cover; and attaching a portion of the second bonding surface of the lid to the third bonding surface of the cradle, thereby forming a fluidic seal resulting from a reaction between the second and third reactive groups.

In yet other embodiments, the method includes functionalizing a portion of the device to provide a fourth bonding surface including a fourth reactive group, where the fourth reactive group is configured to react with the second reactive group of the cover; and attaching a portion of the second bonding surface of the lid to the fourth bonding surface of the device, thereby forming a fluidic seal resulting from a reaction between the second and fourth reactive groups.

In some embodiments, the method further includes: functionalizing a portion of the inactive area of the device to provide a protected surface including a protecting group (e.g., where the functionalizing step includes providing a first reactive surface including a further reactive group and then reacting the further reactive group with a protecting group precursor, thereby providing the protected surface including a protecting group disposed on the portion of the inactive area); and/or functionalizing an active area of the device to provide a detecting surface (e.g., where the functionalizing step includes providing a second reactive surface including a further reactive group and then reacting the further reactive group with one or more capture probes, thereby providing detecting surface configured to detect one or more analytes).

In any embodiment herein, the method includes attaching the device to a cradle (e.g., including a recess configured to house the device). In some embodiments, the package includes a device attached to a cradle.

In any embodiment herein, the method further includes attaching the third bonding surface of the device to the second bonding surface of the lid, thereby forming a second fluidic seal, where the second fluidic seal results from a reaction between the second and third reactive groups.

In any embodiment herein, the method further includes functionalizing in the presence of the one or more capture probes. In any embodiment herein, a fluidic seal is formed in the presence of the one or more capture probes.

In any of the methods herein, steps may be conducted in any order (or sequence) or at the same time.

In any embodiment herein, the lid and/or the cradle includes a functionalized polymer including polynorbornene, polycarbonate, or copolymers thereof.

In any embodiment herein, the reactive group (e.g., first, second, third, etc. reactive group) includes an amino group, a thio group, and/or a hydroxyl group. In a further embodiment, the further reactive group is configured to react with the reactive group (e.g., an amino group, a thio group (e.g., a thioalkoxy group or a thiol group), and/or a hydroxyl group) is selected from the group of an ester (e.g., an acrylate), an imido (e.g., a maleimido or a succinimido), an epoxide, an amido, a carbamido (e.g., a urea derivative), etc.

In any embodiment herein, the reactive group is attached to a linker (e.g., any herein, such as an optionally substituted alkylene or an optionally substituted heteroalkylene).

In any embodiment herein, the reactive group is part of a linking agent (e.g., $L^{1'}$-Lk-$L^{1''}$, where Lk is a linker and where each of $L^{1'}$ and $L^{1''}$ is, independently, a reactive group (e.g., a functional group that is one of a cross-linker group, a binding group, or a click-chemistry group, such as any described herein), and in which each of $L^{1'}$ and $L^{1''}$ can be the same or different). Exemplary linkers include an optionally substituted alkylene or an optionally substituted heteroalkylene. Exemplary linking agents include silanes, in which the reactive group includes —$Si(R^{Si})_4$, where each $R^{Si}$ is, independently, hydrogen, halo, optionally substituted alkoxy, or optionally substituted alkyl.

In any embodiment herein, the one or more capture probes include an antibody, an aptamer, a nucleic acid, a protein, a receptor, and/or an enzyme, or fragments thereof.

In any embodiment herein, the package includes an intermediate layer including a further binding surface, where the intermediate layer is configured to be disposed above the upper surface of the lid and where a further fluidic seal is disposed between the intermediate layer and the upper surface of the lid.

In any embodiment herein, the method includes functionalizing an intermediate layer to provide a further bonding surface including a further reactive group, where the further reactive group is configured to react with the reactive group present on an upper bonding surface of the lid. In some embodiments, the method further includes attaching the further bonding surface of the intermediate layer to the upper bonding surface of the lid. In yet other embodiments, the intermediate layer includes one or more channels, chambers, inlets, and/or vias to provide fluidic communication to the active area of the device.

Definitions

As used herein, the term "about" means+/−10% of any recited value. As used herein, this term modifies any recited value, range of values, or endpoints of one or more ranges.

By "fluidic communication," as used herein, refers to any duct, channel, tube, pipe, chamber, or pathway through which a substance, such as a liquid, gas, or solid may pass substantially unrestricted when the pathway is open. When the pathway is closed, the substance is substantially restricted from passing through. Typically, limited diffusion of a substance through the material of a plate, base, and/or a substrate, which may or may not occur depending on the compositions of the substance and materials, does not constitute fluidic communication.

By "microfluidic" or "micro" is meant having at least one dimension that is less than 1 mm. For instance, a microfluidic structure (e.g., any structure described herein) can have a length, width, height, cross-sectional dimension, circumference, radius (e.g., external or internal radius), or diameter that is less than 1 mm.

As used herein, the terms "top," "bottom," "upper," "lower," "above," and "below" are used to provide a relative relationship between structures. The use of these terms does not indicate or require that a particular structure must be located at a particular location in the apparatus.

By "alkoxy" is meant —OR, where R is an optionally substituted alkyl group, as described herein. Exemplary alkoxy groups include methoxy, ethoxy, butoxy, trihaloalkoxy, such as trifluoromethoxy, etc. The alkoxy group can be substituted or unsubstituted. For example, the alkoxy group can be substituted with one or more substitution groups, as described herein for alkyl. Exemplary unsubstituted alkoxy groups include $C_{1-3}$, $C_{1-6}$, $C_{1-12}$, $C_{1-16}$, $C_{1-18}$, $C_{1-20}$, or $C_{1-24}$ alkoxy groups.

By "alkyl" and the prefix "alk" is meant a branched or unbranched saturated hydrocarbon group of 1 to 24 carbon atoms, such as methyl, ethyl, n-propyl, isopropyl, n-butyl, isobutyl, s-butyl, t-butyl, n-pentyl, isopentyl, s-pentyl, neopentyl, hexyl, heptyl, octyl, nonyl, decyl, dodecyl, tetradecyl, hexadecyl, eicosyl, tetracosyl, and the like. The alkyl group can be cyclic (e.g., $C_{3-24}$ cycloalkyl) or acyclic. The alkyl group can be branched or unbranched. The alkyl group can also be substituted or unsubstituted. For example, the alkyl group can be substituted with one, two, three or, in the case of alkyl groups of two carbons or more, four substituents independently selected from the group consisting of: (1) $C_{1-6}$ alkoxy (e.g., —OAk, in which Ak is an alkyl group, as defined herein); (2) $C_{1-6}$ alkylsulfinyl (e.g., —S(O)Ak, in which Ak is an alkyl group, as defined herein); (3) $C_{1-6}$ alkylsulfonyl (e.g., —$SO_2$Ak, in which Ak is an alkyl group, as defined herein); (4) amino (e.g., —$NR^{N1}R^{N2}$, where each of $R^{N1}$ and $R^{N2}$ is, independently, H or optionally substituted alkyl, or $R^{N1}$ and $R^{N2}$, taken together with the nitrogen atom to which each are attached, form a heterocyclyl group); (5) aryl; (6) arylalkoxy (e.g., —$OA^LAr$, in which $A^L$ is an alkylene group and Ar is an alkyl group, as defined herein); (7) aryloyl (e.g., —C(O)Ar, in which Ar is an alkyl group, as defined herein); (8) azido (e.g., an —$N_3$ group); (9) cyano (e.g., a —CN group); (10) carboxyaldehyde (e.g., a —C(O)H group); (11) $C_{3-8}$ cycloalkyl; (12) halo; (13) heterocyclyl (e.g., a 5-, 6- or 7-membered ring, unless otherwise specified, containing one, two, three, or four non-carbon heteroatoms (e.g., independently selected from the group consisting of nitrogen, oxygen, phosphorous, sulfur, or halo)); (14) heterocyclyloxy (e.g., —OHet, in which Het is a heterocyclyl group); (15) heterocyclyloyl (e.g., —C(O)Het, in which Het is a heterocyclyl group); (16) hydroxyl (e.g., a —OH group); (17) N-protected amino; (18) nitro (e.g., an —$NO_2$ group); (19) oxo (e.g., an =O group); (20) $C_{3-8}$ spirocyclyl (e.g., an alkylene diradical, both ends of which are bonded to the same carbon atom of the parent group to form a spirocyclyl group); (21) $C_{1-6}$ thioalkoxy (e.g., —SAk, in which Ak is an alkyl group, as defined herein); (22) thiol (e.g., an —SH group); (23) —$CO_2R^A$, where $R^A$ is selected from the group consisting of (a) hydrogen, (b) $C_{1-6}$ alkyl, (c) $C_{4-18}$ aryl, and (d) $C_{1-6}$ alk-$C_{4-18}$ aryl; (24) —C(O)$NR^BR^C$, where each of $R^B$ and $R^C$ is, independently, selected from the group consisting of (a) hydrogen, (b) $C_{1-6}$ alkyl, (c) $C_{4-18}$ aryl, and (d) $C_{1-6}$ alk-$C_{4-18}$ aryl; (25) —$SO_2R^D$, where $R^D$ is selected from the group consisting of (a) $C_{1-6}$ alkyl, (b) $C_{4-18}$ aryl, and (c) $C_{1-6}$ alk-$C_{4-18}$ aryl; (26) —$SO_2NR^ER^F$, where each of $R^E$ and $R^F$ is, independently, selected from the group consisting of (a) hydrogen, (b) $C_{1-6}$ alkyl, (c) $C_{4-18}$ aryl, and (d) $C_{1-6}$ alk-$C_{4-18}$ aryl; and (27) —$NR^GR^H$, where each of $R^G$ and $R^H$ is, independently, selected from the group consisting of (a) hydrogen, (b) an N-protecting group, (c) $C_{1-6}$ alkyl, (d) $C_{2-6}$ alkenyl, (e) $C_{2-6}$ alkynyl, (f) $C_{4-18}$ aryl, (g) $C_{1-6}$ alk-$C_{4-18}$ aryl, (h) $C_{3-8}$cycloalkyl, and (i) $C_{1-6}$ alk-$C_{3-8}$cycloalkyl, wherein in one embodiment no two groups are bound to the nitrogen atom through a carbonyl group or a sulfonyl group. The alkyl group can be a primary, secondary, or tertiary alkyl group substituted with one or more substituents (e.g., one or more halo or alkoxy). In some embodiments, the unsubstituted alkyl group is a $C_{1-3}$, $C_{1-6}$, $C_{1-12}$, $C_{1-16}$, $C_{1-18}$, $C_{1-20}$, or $C_{1-24}$ alkyl group.

By "alkylene" is meant a bivalent form of an alkyl group, as described herein. Exemplary alkylene groups include methylene, ethylene, propylene, butylene, etc. In some embodiments, the alkylene group is a $C_{1-3}$, $C_{1-6}$, $C_{1-12}$, $C_{1-16}$, $C_{1-18}$, $C_{1-20}$, $C_{1-24}$, $C_{2-3}$, $C_{2-6}$, $C_{2-12}$, $C_{2-16}$, $C_2$— is, $C_{2-20}$, or $C_{2-24}$ alkylene group. The alkylene group can be branched or unbranched. The alkylene group can also be substituted or unsubstituted. For example, the alkylene group can be substituted with one or more substitution groups, as described herein for alkyl.

By "alkynyl" is meant an optionally substituted $C_{2-24}$ alkyl group having one or more triple bonds. The alkynyl group can be cyclic or acyclic and is exemplified by ethynyl, 1-propynyl, and the like. The alkynyl group can also be substituted or unsubstituted. For example, the alkynyl group can be substituted with one or more substitution groups, as described herein for alkyl.

By "amido" is meant —C(O)$NR^{N1}R^{N2}$, where each of $R^{N1}$ and $R^{N2}$ is, independently, H, optionally substituted alkyl, or optionally substituted aryl; or where a combination of $R^{N1}$ and $R^{N2}$, taken together with the nitrogen atom to which each are attached, form a heterocyclyl group, as defined herein.

By "amino" is meant —$NR^{N1}R^{N2}$, where each of $R^{N1}$ and $R^{N2}$ is, independently, H or optionally substituted alkyl, or $R^{N1}$ and $R^{N2}$, taken together with the nitrogen atom to which each are attached, form a heterocyclyl group, as defined herein.

By "aryl" is meant a group that contains any carbon-based aromatic group including, but not limited to, benzyl, naphthalene, phenyl, biphenyl, phenoxybenzene, and the like. The term "aryl" also includes "heteroaryl," which is defined as a group that contains an aromatic group that has at least one heteroatom incorporated within the ring of the aromatic group. Examples of heteroatoms include, but are not limited to, nitrogen, oxygen, sulfur, and phosphorus. Likewise, the term "non-heteroaryl," which is also included in the term "aryl," defines a group that contains an aromatic group that does not contain a heteroatom. The aryl group can be substituted or unsubstituted. The aryl group can be substituted with one, two, three, four, or five substituents independently selected from the group consisting of: (1) $C_{1-6}$ alkanoyl (e.g., —C(O)Ak, in which Ak is an alkyl group, as defined herein); (2) $C_{1-6}$ alkyl; (3) $C_{1-6}$ alkoxy (e.g., —OAk, in which Ak is an alkyl group, as defined herein); (4) $C_{1-6}$ alkoxy-$C_{1-6}$ alkyl (e.g., an alkyl group, which is substituted with an alkoxy group —OAk, in which Ak is an alkyl group, as defined herein); (5) $C_{1-6}$ alkylsulfinyl (e.g., —S(O)Ak, in which Ak is an alkyl group, as defined herein); (6) $C_{1-6}$ alkylsulfinyl-$C_{1-6}$ alkyl (e.g., an alkyl group, which is substituted by an alkylsulfinyl group —S(O)Ak, in which Ak is an alkyl group, as defined herein); (7) $C_{1-6}$ alkylsulfonyl (e.g., —$SO_2$Ak, in which Ak is an alkyl group, as defined herein); (8) $C_{1-6}$ alkylsulfonyl-$C_{1-6}$ alkyl (e.g., an alkyl group, which is substituted by an alkylsulfonyl group —$SO_2$Ak, in which Ak is an alkyl group, as defined herein); (9) aryl; (10) amino (e.g., —$NR^{N1}R^{N2}$ where each of $R^{N1}$ and $R^{N2}$ is, independently, H or optionally substituted alkyl, or $R^{N1}$ and $R^{N2}$, taken together with the nitrogen atom to which each are attached, form a heterocyclyl group); (11) $C_{1-6}$ aminoalkyl (e.g., meant an alkyl group, as defined herein, substituted by an amino group); (12) heteroaryl; (13) $C_{1-6}$ alk-$C_{4-18}$ aryl (e.g., -$A^L$Ar, in which $A^L$ is an alkylene group and Ar is an alkyl group, as defined herein); (14) aryloyl (e.g., —C(O)Ar, in which Ar is an alkyl group, as defined herein); (15) azido (e.g., an —$N_3$ group); (16) cyano (e.g., a —CN group); (17) $C_{1-6}$ azidoalkyl (e.g., a —$N_3$ azido group attached to the parent molecular group through an alkyl group, as defined herein); (18) carboxyaldehyde (e.g., a —C(O)H group); (19) carboxyaldehyde-$C_{1-6}$ alkyl (e.g., -$A^L$C(O)H, in which $A^L$ is an alkylene group, as defined herein); (20) $C_{3-8}$ cycloalkyl; (21) $C_{1-6}$ alk-$C_{3-8}$ cycloalkyl (e.g., -$A^L$Cy, in which $A^L$ is an alkylene group and Cy is a cycloalkyl group, as defined herein); (22) halo (e.g., F, Cl, Br, or I); (23) $C_{1-6}$ haloalkyl (e.g., an alkyl group, as defined herein, substituted with one or more halo); (24) heterocyclyl; (25) heterocyclyloxy (e.g., —OHet, in which Het is a heterocyclyl group); (26) heterocyclyloyl (e.g., —C(O)Het, in which Het is a heterocyclyl group); (16) hydroxyl (e.g., a —OH group); (27) hydroxyl (e.g., a —OH group); (28) $C_{1-6}$ hydroxyalkyl (e.g., an alkyl group, as defined herein, substituted by one to three hydroxyl groups, with the proviso that no more than one hydroxyl group may be attached to a single carbon atom of the alkyl group); (29) nitro (e.g., an —$NO_2$ group); (30) $C_{1-6}$ nitroalkyl (e.g., an alkyl group, as defined herein, substituted by one to three nitro groups); (31) N-protected amino; (32) N-protected amino-$C_{1-6}$ alkyl; (33) oxo (e.g., an =O group); (34) $C_{1-6}$ thioalkoxy (e.g., —SAk, in which Ak is an alkyl group, as defined herein); (35) thio-$C_{1-6}$ alkoxy-$C_{1-6}$ alkyl (e.g., an alkyl group, which is substituted by an thioalkoxy group —SAk, in which Ak is an alkyl group, as defined herein); (36) —$(CH_2)_rCO_2R^A$, where r is an integer of from zero to four, and $R^A$ is selected from the group consisting of (a) hydrogen, (b) $C_{1-6}$ alkyl, (c) $C_{4-18}$ aryl, and (d) $C_{1-6}$ alk-$C_{4-18}$ aryl; (37) —$(CH_2)_rCONR^BR^C$, where r is an integer of from zero to four and where each $R^B$ and $R^C$ is independently selected from the group consisting of (a) hydrogen, (b) $C_{1-6}$ alkyl, (c) $C_{4-18}$ aryl, and (d) $C_{1-6}$ alk-$C_{4-18}$ aryl; (38) —$(CH_2)_rSO_2R^D$, where r is an integer of from zero to four and where $R^D$ is selected from the group consisting of (a) $C_{1-6}$ alkyl, (b) $C_{4-18}$ aryl, and (c) $C_{1-6}$ alk-$C_{4-18}$ aryl; (39) —$(CH_2)_rSO_2NR^ER^F$, where r is an integer of from zero to four and where each of $R^E$ and $R^F$ is, independently, selected from the group consisting of (a) hydrogen, (b) $C_{1-6}$ alkyl, (c) $C_{4-18}$ aryl, and (d) $C_{1-6}$ alk-$C_{4-18}$ aryl; (40) —$(CH_2)_rNR^GR^H$, where r is an integer of from zero to four and where each of $R^G$ and $R^H$ is, independently, selected from the group consisting of (a) hydrogen, (b) an N-protecting group, (c) $C_{1-6}$ alkyl, (d) $C_{2-6}$ alkenyl, (e) $C_{2-6}$ alkynyl, (f) $C_{4-18}$ aryl, (g) $C_{1-6}$ alk-$C_{4-18}$ aryl, (h) $C_{3-8}$ cycloalkyl, and (i) $C_{1-6}$ alk-$C_{3-8}$ cycloalkyl, wherein in one embodiment no two groups are bound to the nitrogen atom through a carbonyl group or a sulfonyl group; (41) thiol; (42) perfluoroalkyl (e.g., an alkyl group, as defined herein, having each hydrogen atom substituted with a fluorine atom); (43) perfluoroalkoxy (e.g., —ORf, in which Rf is an alkyl group, as defined herein, having each hydrogen atom substituted with a fluorine atom); (44) aryloxy (e.g., —OAr, where Ar is an optionally substituted aryl group, as described herein); (45) cycloalkoxy (e.g., —OCy, in which Cy is a cycloalkyl group, as defined herein); (46) cycloalkylalkoxy (e.g., —$OA^LCy$, in which $A^L$ is an alkylene group and Cy is a cycloalkyl group, as defined herein); and (47) arylalkoxy (e.g., —$OA^LAr$, in which $A^L$ is an alkylene group and Ar is an alkyl group, as defined herein). In particular embodiments, an unsubstituted aryl group is a $C_{4-18}$, $C_{4-14}$, $C_{4-12}$, $C_{4-10}$, $C_{6-18}$, $C_{6-14}$, $C_{6-12}$, or $C_{6-10}$ aryl group.

By "arylene" is meant a bivalent form of an aryl group, as described herein. Exemplary arylene groups include phenylene, naphthylene, biphenylene, triphenylene, diphenyl ether, acenaphthenylene, anthrylene, or phenanthrylene. In some embodiments, the arylene group is a $C_{4-18}$, $C_{4-14}$, $C_{4-12}$, $C_{4-10}$, $C_{6-8}$, $C_{6-14}$, $C_{6-12}$, or $C_{6-10}$ arylene group. The arylene group can be branched or unbranched. The arylene group can also be substituted or unsubstituted. For example, the arylene group can be substituted with one or more substitution groups, as described herein for aryl.

By "azido" is meant an —$N_3$ group.

By "carbamido" is meant —$NR^{N1}C(O)R^{N2}R^{N3}$, where each of $R^{N1}$ and $R^{N2}$ and $R^{N3}$ is, independently, H, optionally substituted alkyl, or optionally substituted aryl; or where a combination of $R^{N2}$ and $R^{N3}$, taken together with the nitrogen atom to which each are attached, form a heterocyclyl group, as defined herein.

By "carbonyl" is meant a —C(O)— group, which can also be represented as >C=O.

By "carboxyaldehyde" is meant a —C(O)H group.

By "carboxyaldehydealkyl" is meant a carboxyaldehyde group, as defined herein, attached to the parent molecular group through an alkylene group, as defined herein.

By "carboxyl" is meant a —$CO_2H$ group.

By "cycloalkyl" is meant a monovalent saturated or unsaturated non-aromatic cyclic hydrocarbon group of from three to eight carbons, unless otherwise specified, and is exemplified by cyclopropyl, cyclobutyl, cyclopentyl, cyclohexyl, cycloheptyl, bicyclo[2.2.1.]heptyl and the like. The cycloalkyl group can also be substituted or unsubstituted. For example, the cycloalkyl group can be substituted with one or more groups including those described herein for alkyl.

By "halo" is meant F, Cl, Br, or I.

By "heteroalkyl" is meant an alkyl group, as defined herein, containing one, two, three, or four non-carbon heteroatoms (e.g., independently selected from the group consisting of nitrogen, oxygen, phosphorous, sulfur, or halo).

By "heteroalkylene" is meant a divalent form of an alkylene group, as defined herein, containing one, two, three, or four non-carbon heteroatoms (e.g., independently selected from the group consisting of nitrogen, oxygen, phosphorous, sulfur, or halo).

By "heteroaryl" is meant a subset of heterocyclyl groups, as defined herein, which are aromatic, i.e., they contain 4n+2 pi electrons within the mono- or multicyclic ring system.

By "heteroarylene" is meant a divalent form of a heteroaryl group, as defined herein, containing one, two, three, or four non-carbon heteroatoms (e.g., independently selected from the group consisting of nitrogen, oxygen, phosphorous, sulfur, or halo).

By "heterocyclyl" is meant a 5-, 6- or 7-membered ring, unless otherwise specified, containing one, two, three, or four non-carbon heteroatoms (e.g., independently selected from the group consisting of nitrogen, oxygen, phosphorous, sulfur, or halo). The 5-membered ring has zero to two double bonds and the 6- and 7-membered rings have zero to three double bonds. The term "heterocyclyl" also includes bicyclic, tricyclic and tetracyclic groups in which any of the above heterocyclic rings is fused to one, two, or three rings independently selected from the group consisting of an aryl ring, a cyclohexane ring, a cyclohexene ring, a cyclopentane ring, a cyclopentene ring, and another monocyclic heterocyclic ring, such as indolyl, quinolyl, isoquinolyl, tetrahydroquinolyl, benzofuryl, benzothienyl and the like. Heterocyclics include thiiranyl, thietanyl, tetrahydrothienyl, thianyl, thiepanyl, aziridinyl, azetidinyl, pyrrolidinyl, piperidinyl, azepanyl, pyrrolyl, pyrrolinyl, pyrazolyl, pyrazolinyl, pyrazolidinyl, imidazolyl, imidazolinyl, imidazolidinyl, pyridyl, homopiperidinyl, pyrazinyl, piperazinyl, pyrimidinyl, pyridazinyl, oxazolyl, oxazolidinyl, isoxazolyl, isoxazolidiniyl, morpholinyl, thiomorpholinyl, thiazolyl, thiazolidinyl, isothiazolyl, isothiazolidinyl, indolyl, quinolinyl, isoquinolinyl, benzimidazolyl, benzothiazolyl, benzoxazolyl, furyl, thienyl, thiazolidinyl, isothiazolyl, isoindazoyl, triazolyl, tetrazolyl, oxadiazolyl, uricyl, thiadiazolyl, pyrimidyl, tetrahydrofuranyl, dihydrofuranyl, tetrahydrothienyl, dihydrothienyl, dihydroindolyl, tetrahydroquinolyl, tetrahydroisoquinolyl, pyranyl, dihydropyranyl, dithiazolyl, benzofuranyl, benzothienyl, and the like.

By "hydroxyl" is meant —OH.

By "imido" is meant —C(O)NR$^{N1}$C(O)—, where R$^{N1}$ is, independently, H, optionally substituted alkyl, or optionally substituted aryl.

By "protecting group" is meant any group intended to protect a reactive group against undesirable synthetic reactions. Commonly used protecting groups are disclosed in "Greene's Protective Groups in Organic Synthesis," John Wiley & Sons, New York, 2007 (4th ed., eds. P. G. M. Wuts and T. W. Greene), which is incorporated herein by reference. O-protecting groups include an optionally substituted alkyl group (e.g., forming an ether with reactive group O), such as methyl, methoxymethyl, methylthiomethyl, benzoyloxymethyl, t-butoxymethyl, etc.; an optionally substituted alkanoyl group (e.g., forming an ester with the reactive group O), such as formyl, acetyl, chloroacetyl, fluoroacetyl (e.g., perfluoroacetyl), methoxyacetyl, pivaloyl, t-butylacetyl, phenoxyacetyl, etc.; an optionally substituted aryloyl group (e.g., forming an ester with the reactive group O), such as —C(O)—Ar, including benzoyl; an optionally substituted alkylsulfonyl group (e.g., forming an alkylsulfonate with reactive group O), such as —SO$_2$—R$^{S1}$, where R$^{S1}$ is optionally substituted C$_{1-12}$ alkyl, such as mesyl or benzylsulfonyl; an optionally substituted arylsulfonyl group (e.g., forming an arylsulfonate with reactive group O), such as —SO$_2$—R$^{S4}$, where R$^{S4}$ is optionally substituted C$_{4-18}$ aryl, such as tosyl or phenylsulfonyl; an optionally substituted alkoxycarbonyl or aryloxycarbonyl group (e.g., forming a carbonate with reactive group O), such as —C(O)—OR$^{T1}$, where R$^{T1}$ is optionally substituted C$_{1-12}$ alkyl or optionally substituted C$_{4-8}$ aryl, such as methoxycarbonyl, methoxymethylcarbonyl, t-butyloxycarbonyl (Boc), or benzyloxycarbonyl (Cbz); or an optionally substituted silyl group (e.g., forming a silyl ether with reactive group O), such as —Si—(R$^{T2}$)$_3$, where each R$^{T2}$ is, independently, optionally substituted C$_{1-12}$ alkyl or optionally substituted C$_{4-18}$ aryl, such as trimethylsilyl, t-butyldimethylsilyl, or t-butyldiphenylsilyl. N-protecting groups include, e.g., formyl, acetyl, benzoyl, pivaloyl, t-butylacetyl, alanyl, phenylsulfonyl, benzyl, Boc, and Cbz. Such protecting groups can employ any useful agent to cleave the protecting group, thereby restoring the reactivity of the unprotected reactive group.

By "thio" is meant an —S— group

By "thioalkoxy" is meant an alkyl group, as defined herein, attached to the parent molecular group through a sulfur atom. Exemplary unsubstituted thioalkoxy groups include C$_{1-6}$ thioalkoxy.

By "thiol" is meant an —SH group.

By "attaching," "attachment," or related word forms is meant any covalent or non-covalent bonding interaction between two components. Non-covalent bonding interactions include, without limitation, hydrogen bonding, ionic interactions, halogen bonding, electrostatic interactions, π bond interactions, hydrophobic interactions, inclusion complexes, clathration, van der Waals interactions, and combinations thereof.

Other features and advantages of the invention will be apparent from the following description and the claims.

Figure 9A:
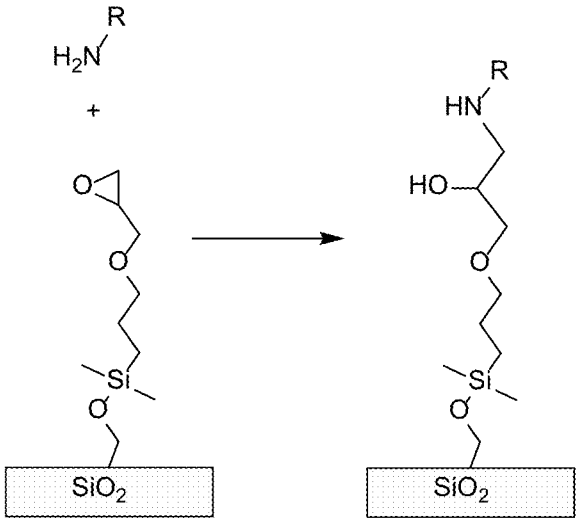
Figure 9B:
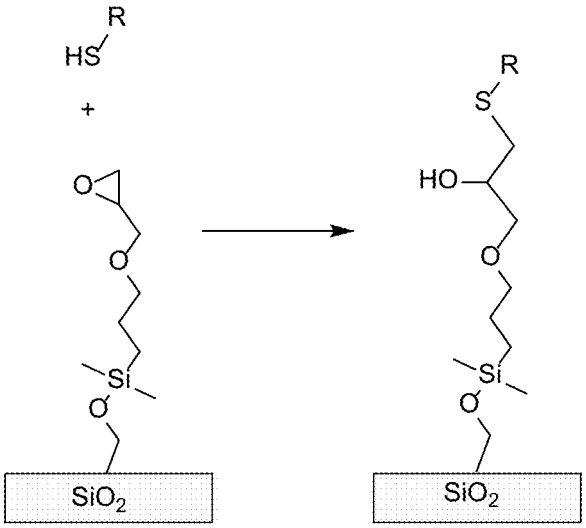

FIG. 9A-9B shows schematics of exemplary linking agents disposed on an exemplary bonding surface (e.g., $SiO_2$). Provided are a schematic showing an exemplary linking agent having an epoxide reactive group that reacts with an agent (e.g., an amine compound, $NH_2R$) to create an amino reactive group (e.g., —NHR, in which R is any useful chemical moiety) (FIG. 9A) and another schematic showing an exemplary linking agent having an epoxide reactive group that reacts with an agent (e.g., a thiol compound, HSR) to create a thioalkoxy reactive group (e.g., —SR, in which R is any useful chemical moiety) (FIG. 9B).

Figure 10A:
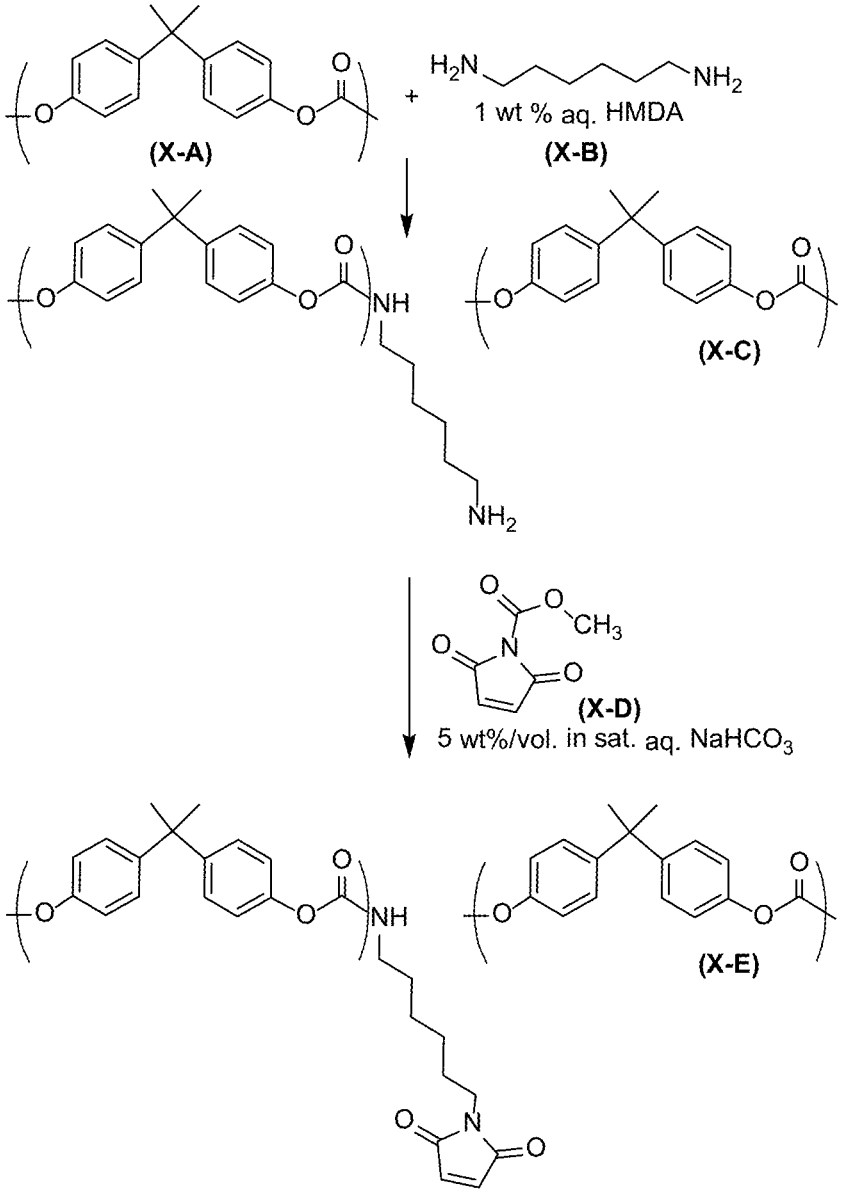
Figure 10B:
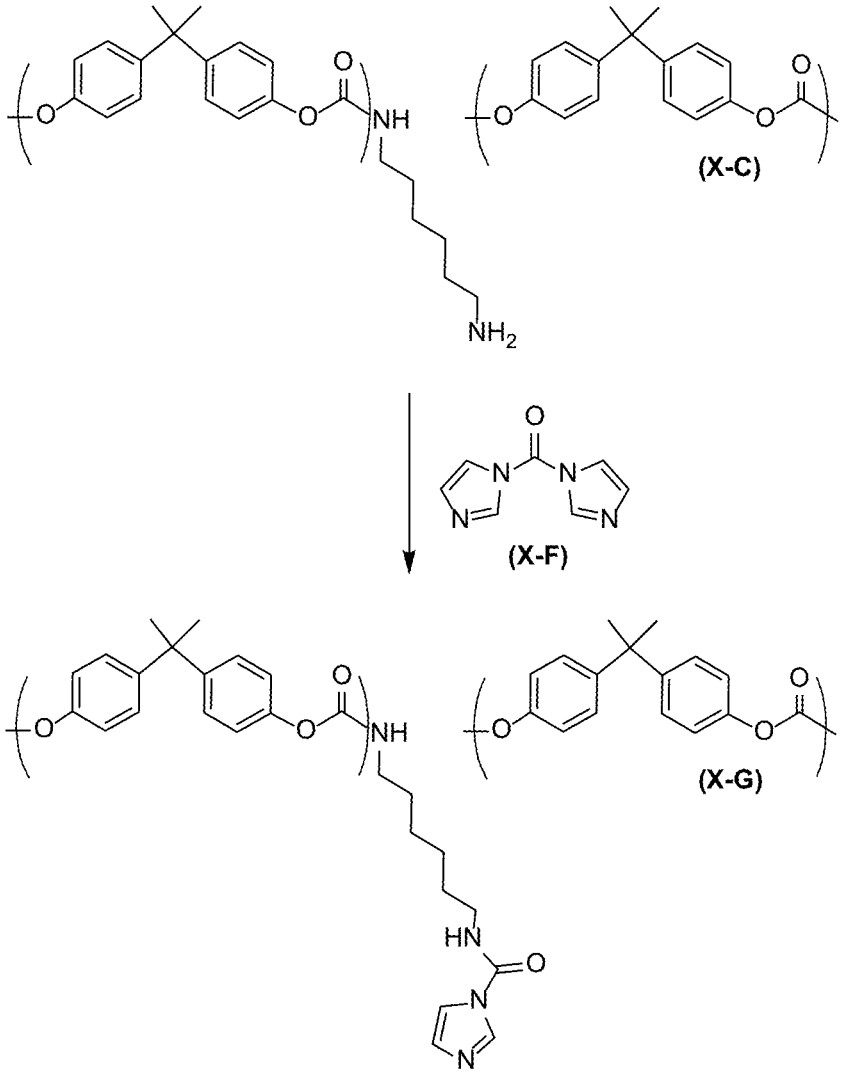

FIG. 10A-10B shows schematics of a bonding surface on a polymer (e.g., polycarbonate, X-A). Provided is a schematic (FIG. 10A) showing a reaction of the polycarbonate (X-A) with an exemplary first linking agent (e.g., a diamine compound, such as hexamethylene diamine (HMDA, X-B)) to provide a linker moiety and then reaction with methoxycarbonyl maleimide (X-D) to provide a maleimide reactive group. The final product is a functionalized copolymer (X-E) having a linker (e.g., a $C_6$ alkylene) terminated by an imido reactive group (e.g., a maleimido group). Also provided is a further schematic (FIG. 10B) showing reaction of an amino-functionalized polycarbonate (X-C) with diheterocyclyl ketone (e.g., a di(1H-imidazol-1-yl)methanone (X-F), e.g., in a methanolic solution thereof) to provide a carbamido reactive group. The final product is a functionalized copolymer (X-G) having a linker (e.g., a $C_6$ alkylene) terminated by a carbamido reactive group (e.g., an imidazolyl-based carbamido group).

Figure 11A:
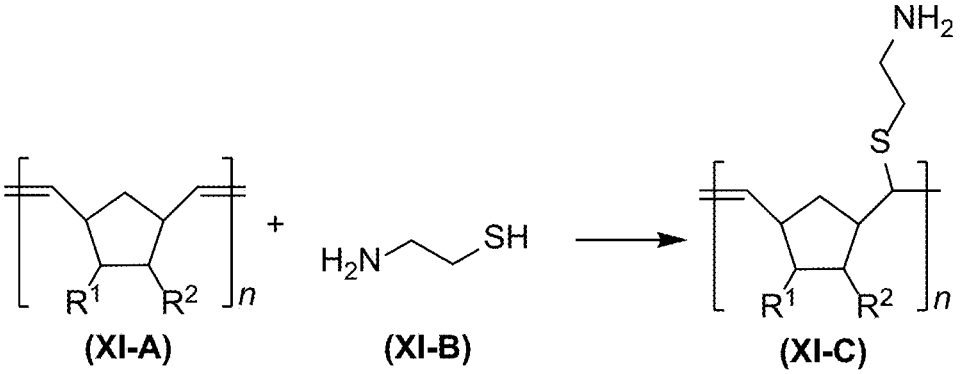
Figure 11B:
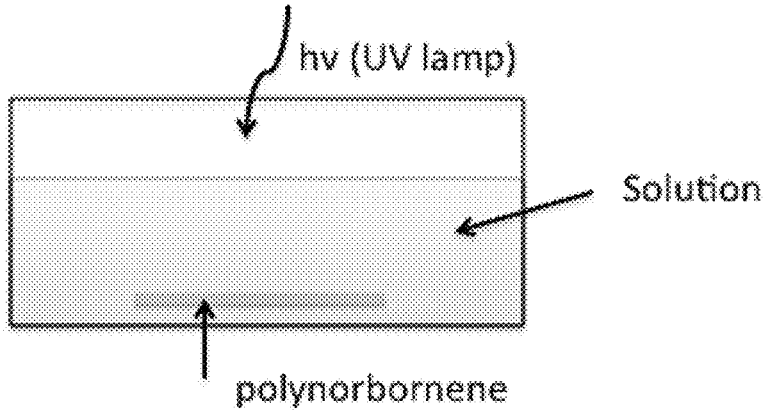

FIG. 11A-11B shows schematics of modifying a polynorbornene surface to provide a bonding surface. Provided are a schematic of a reaction (FIG. 11A) between polynorbornene (X1-A) with a thiol compound (e.g., 2-mercaptoethylamine, XI-B) to provide a polymer having an amino reactive group (XI-C), as well as a schematic of an experimental setup (FIG. 11B) for conducting such a reaction in the presence of a solution including the thiol compound and a photoinitiator (e.g., Irgacure® 819, bis(2,4,6-trimethylbenzoyl)-phenylphosphineoxide).

Figure 12A:
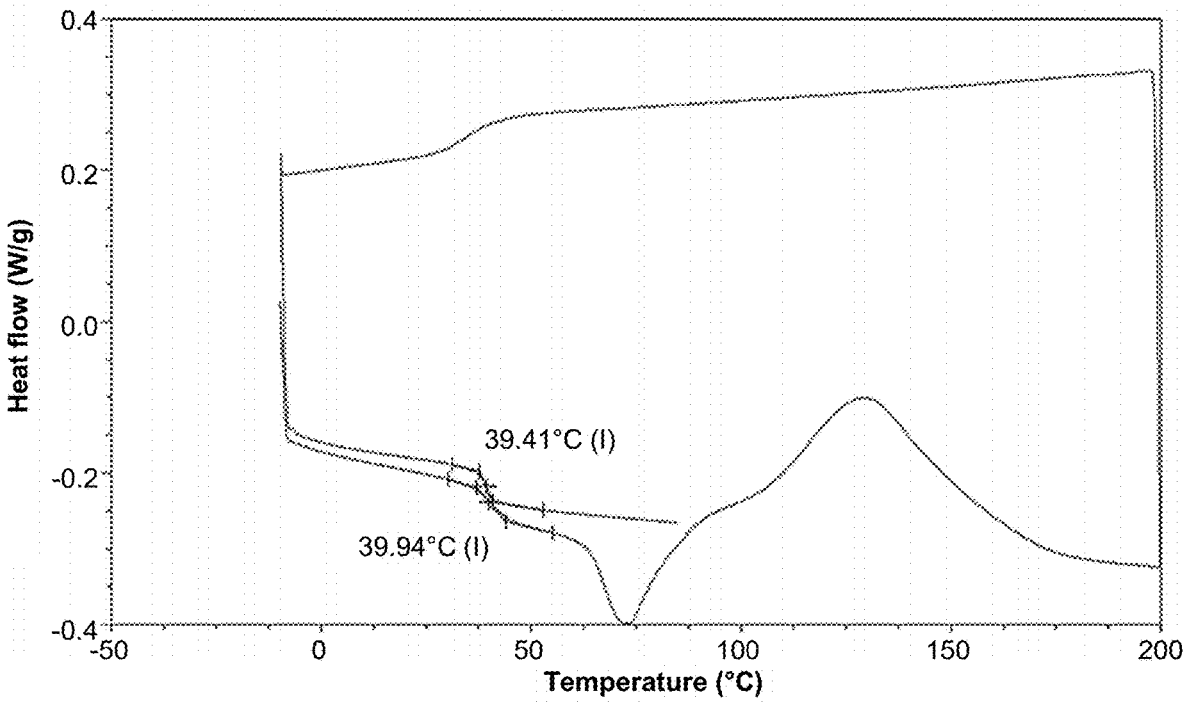
Figure 12B:
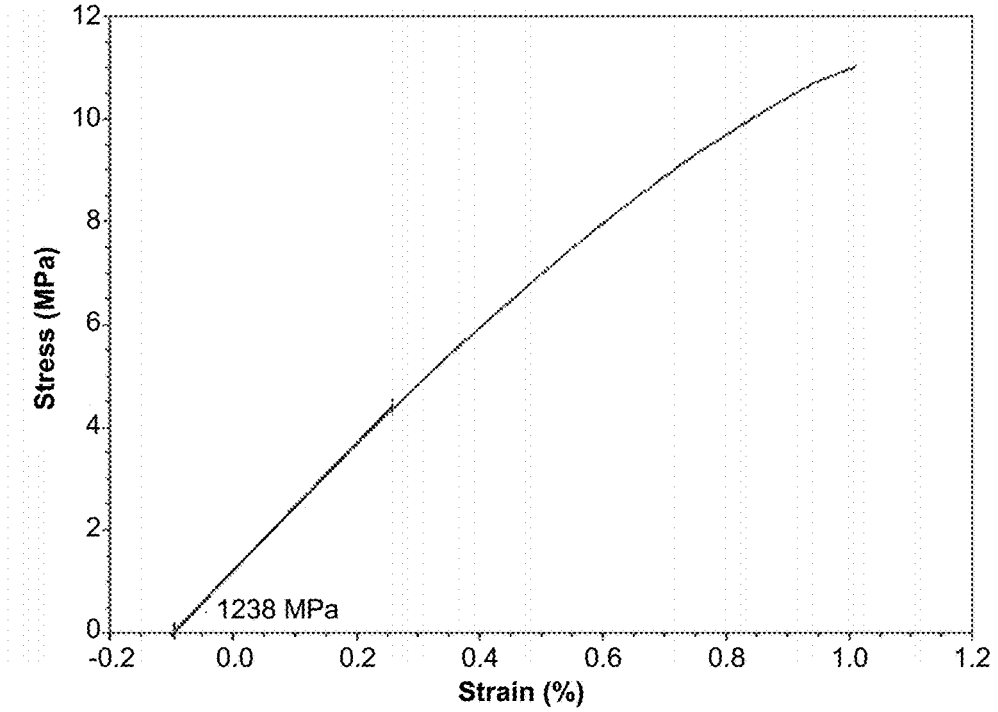

FIG. 12A-12B shows graphs of material characterization of functionalized polynorbornene, including differential scanning calorimetry (DSC) characterization (FIG. 12A) and dynamic mechanical analysis (DMA) characterization (FIG. 12B).

Figure 13A:
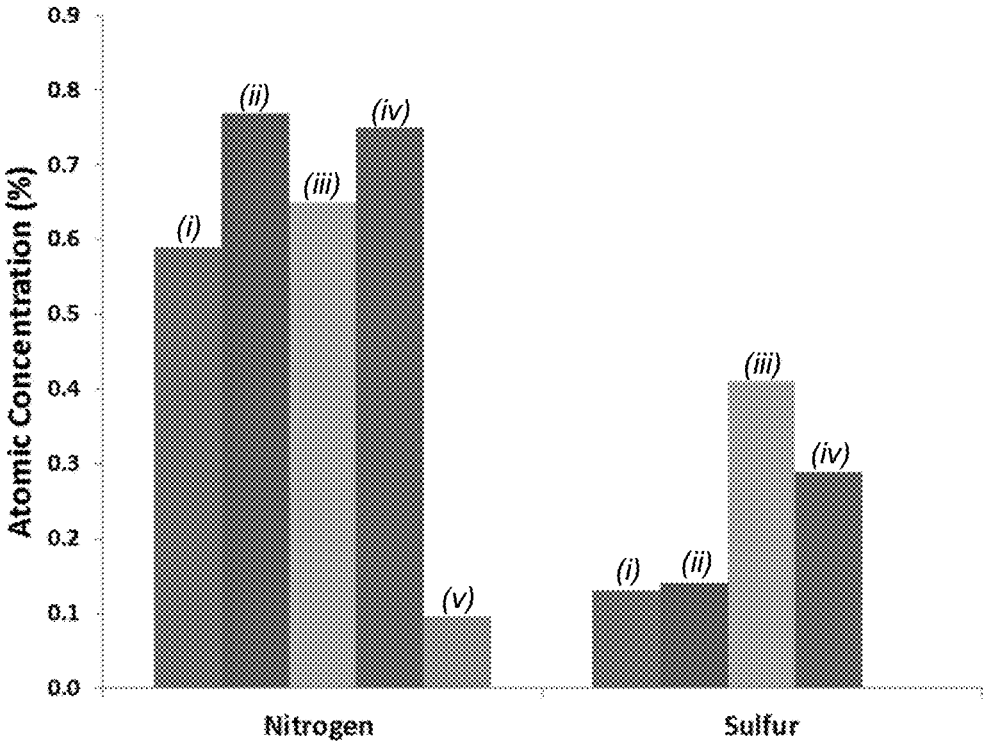
Figure 13B:
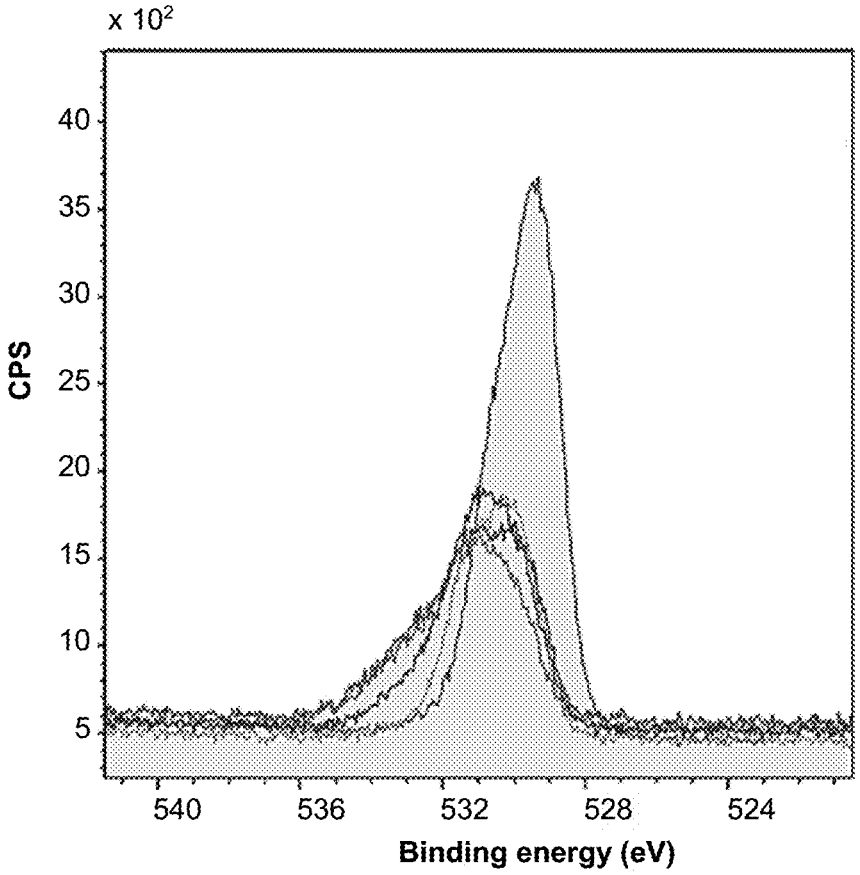

FIG. 13A-13B shows graphs of X-ray photoelectron spectroscopy (XPS) characterization of the surface of functionalized polynorbornene, including atomic concentration of nitrogen and sulfur at the surface (FIG. 13A) and oxygen concentration at the surface over time (FIG. 13B). In FIG. 13A, data are provided for various exposure times, including (i) 10 minutes of UV exposure with no photoinitiator, (ii) 1 minute of UV exposure, (iii) 10 minutes of UV exposure, (iv) 30 minutes of UV exposure, and (v) native polymer.

Figure 14:
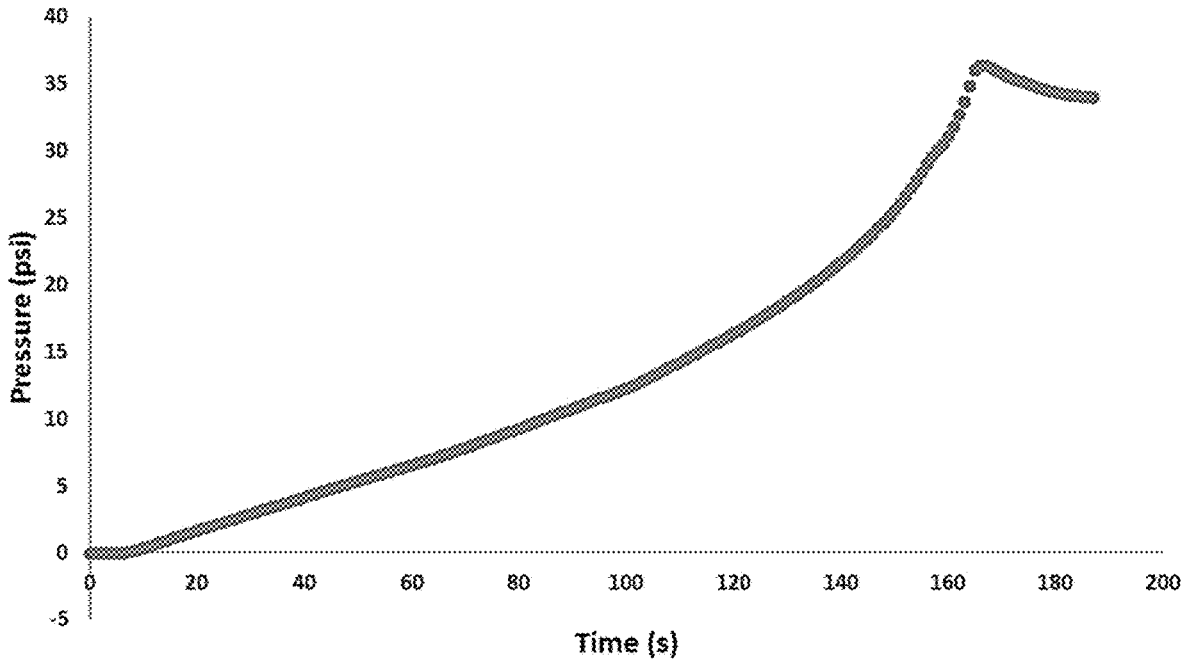

FIG. 14 shows a graph of microfluidic burst testing, in which a polynorbornene microfluidic lid was functionalized with an aminated thiol and was bonded to a N-hydroxysuccinimide (NHS) silane coated silicon wafer.

DETAILED DESCRIPTION OF THE INVENTION

The present invention relates to an encapsulated microfluidic package, as well as methods for making such a package. In general, the package includes a device configured to detect a target analyte (e.g., any described herein). Any useful device can be employed, e.g., a sensor, a resonator, a surface acoustic wave (SAW) sensor, a biosensor, a shear-horizontal surface acoustic wave (SE-SAW) sensor, a transducer, a cell lysing device, as well as any described in U.S. Pat. Nos. 9,512,421; 9,096,823; 8,709,791; 8,669,688; and 7,878,063, each of which is incorporated herein by reference in its entirety. Optionally, the device can include one or more capture probes (e.g., any described herein). In some instances, the device can be attached (e.g., reversibly or irreversibly) to a cradle to support the device.

The package can further include a lid, which in turn has a chamber (e.g., a recess, or any other chamber described herein) in fluidic communication with the device. In this way, fluidic access can be provided to the device (e.g., to deliver one or more samples, reagents, chemical compounds, etc.).

Bonding between each structure of the package can be implemented in any useful manner. Each bonding surface can include one or more reactive groups (e.g., same or different reactive groups on a continuous surface). In particular, bonding between a first surface and a second surface can be implemented by choosing a pair of reactive groups that will react (e.g., a first reactive group having a nucleophilic group and a second reactive group having an electrophilic group; or a click-chemistry reaction pair, as described herein). For instance, a first bonding surface (e.g., disposed on a portion of a lid) can include a first reactive group, and a second bonding surface (e.g., disposed on a portion of a cradle and/or a device) can include a second reactive group configured to react with the first reactive group, thereby forming a bond (e.g., a covalent bond).

Figure 1A:
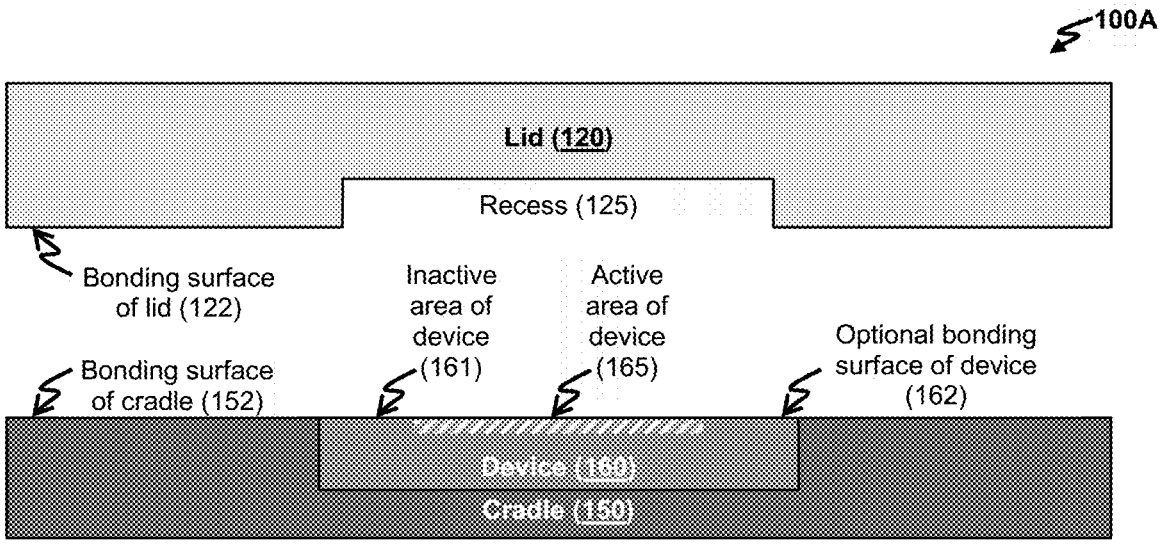
FIG. 1A-1B shows schematics of an exemplary microfluidic package. Provided are a cross-sectional view of the package 100A prior to assembly (FIG. 1A) and a cross-sectional view of the package 100B after assembly (FIG. 1B).

FIG. 1A provides an exemplary microfluidic package 100A having various bonding surfaces. As can be seen, the package 100A includes a lid 120, a cradle 150, and a device 160. The lid 120 includes a bonding surface 122 (e.g., having a first reactive group) disposed on a lower surface. The bonding surface can optionally extend to the recess 125, which is configured to be disposed above the device 160 (e.g., an active area of the device 165).

The exemplary cradle 150 includes a bonding surface 152 having a reactive group (e.g., configured to react with the reactive group present on a bonding surface of the lid). In one non-limiting instance, the bonding surface of the lid is configured to react only with the bonding surface of the cradle. In another non-limiting instance, the bonding surface of the lid is configured to react with the bonding surface of the cradle and a bonding surface of the device.

Figure 1B:
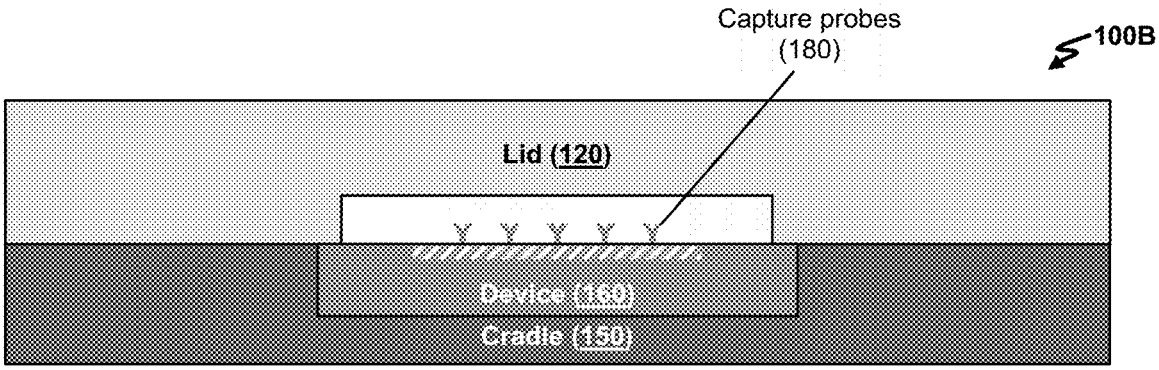

The device can include an active area 165 (e.g., including a capture probe configured to bind to a target) and an inactive area 161 (e.g., lacking a capture probe). The device can also include an optional bonding surface 162, which can include any useful reactive group (e.g., configured to react with the reactive group present on a bonding surface of the lid). Upon assembly (FIG. 1B), the package 100B can include a lid 120 attached to the device 160 and/or cradle 150. As can be seen, one or more capture probes 180 can be present on a surface of the device 160, in which the probes can optionally be present during bonding of the lid.

Figure 2A:
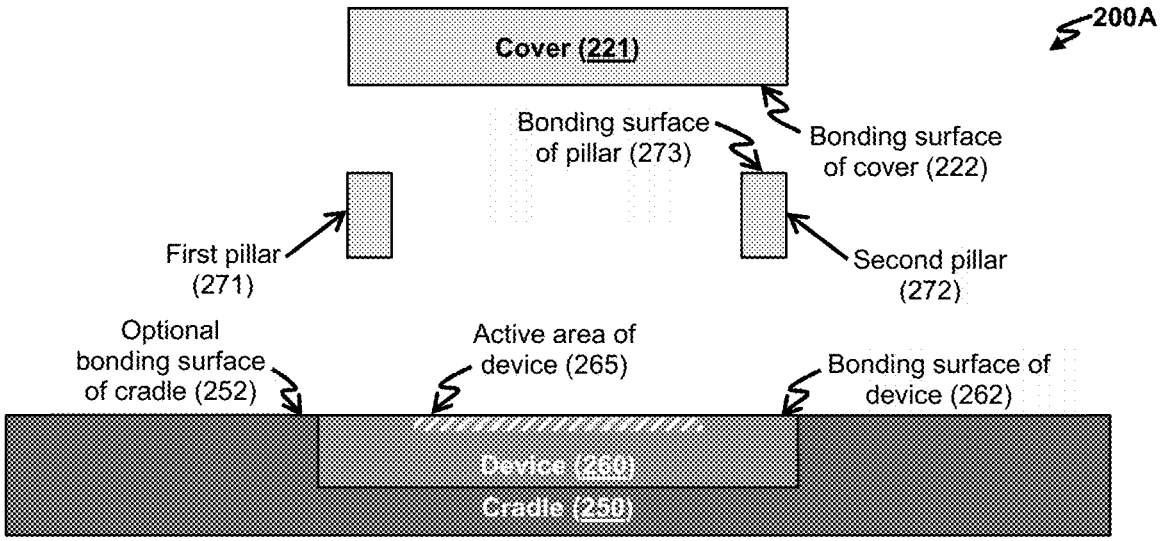
FIG. 2A-2C shows schematics of an exemplary microfluidic package including a cover and pillars to form a lid. Provided are a cross-sectional view of the package 200A prior to assembly (FIG. 2A) and a cross-sectional view of the package 200B after assembly (FIG. 2B). Also provided is a cross-sectional view of another package 2000 in which the lid 2020 forms a bond with a portion of the device 2060 and a portion of the cradle 2050 (FIG. 2C).
Figure 2B:
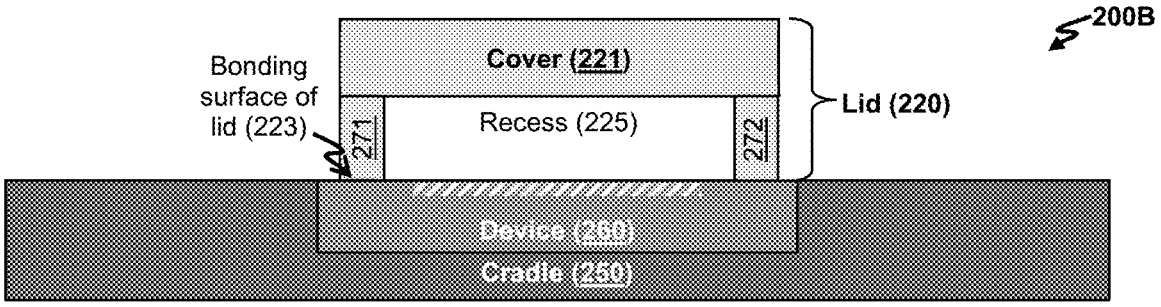
Figure 2C:
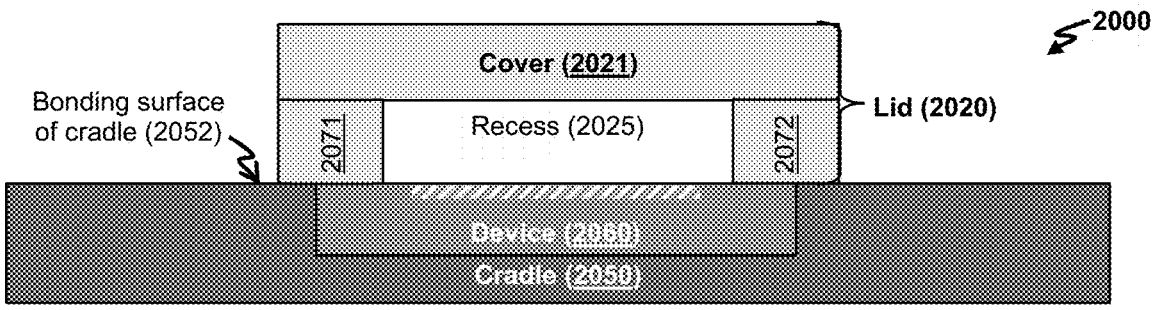

The package can have any useful structures. In one instance, the package includes a lid formed from two substructures: a cover and a plurality of pillars. In this way, the pillars can be pre-positioned in any useful arrangement on the device and/or cradle, and then the cover can be attached to the pillars to form a recess. FIG. 2A-2C provides an exemplary package having such a lid.

In one non-limiting instance, the package 200A prior to assembly (FIG. 2A) includes a cover 221, a first pillar 271, and a second pillar 272. The bonding surface 222 of the cover can be configured to react with an upper bonding surface 273 of a pillar, and a lower bonding surface of a pillar can be configured to react with the bonding surface 262 of the device. The pillars can be arranged to surround the active area 265 of the device 260. Optionally, the cradle 250 can include a bonding surface 252.

After assembly (FIG. 2B), the package 200B can include a lid 220 having a recess 225 formed from the cover 221 and the pillars 271,272. The bonding surface 223 of the lid is reacted with the bonding surface 262 of the device to provide a bond (e.g., a fluidic seal).

Alternatively, the lid can form a fluidic seal with not only the device but also with the cradle. As seen in FIG. 2C, the package 2000 can include a lid 2020 attached to a portion of the device 2060 and a portion of the cradle 2050. As can be seen, the cover 2021 and pillars 2021,2072 are configured to provide a seal between the lid and the bonding surface 2052 of the cradle and between the lid and a bonding surface of the device 2060.

Figure 3A:
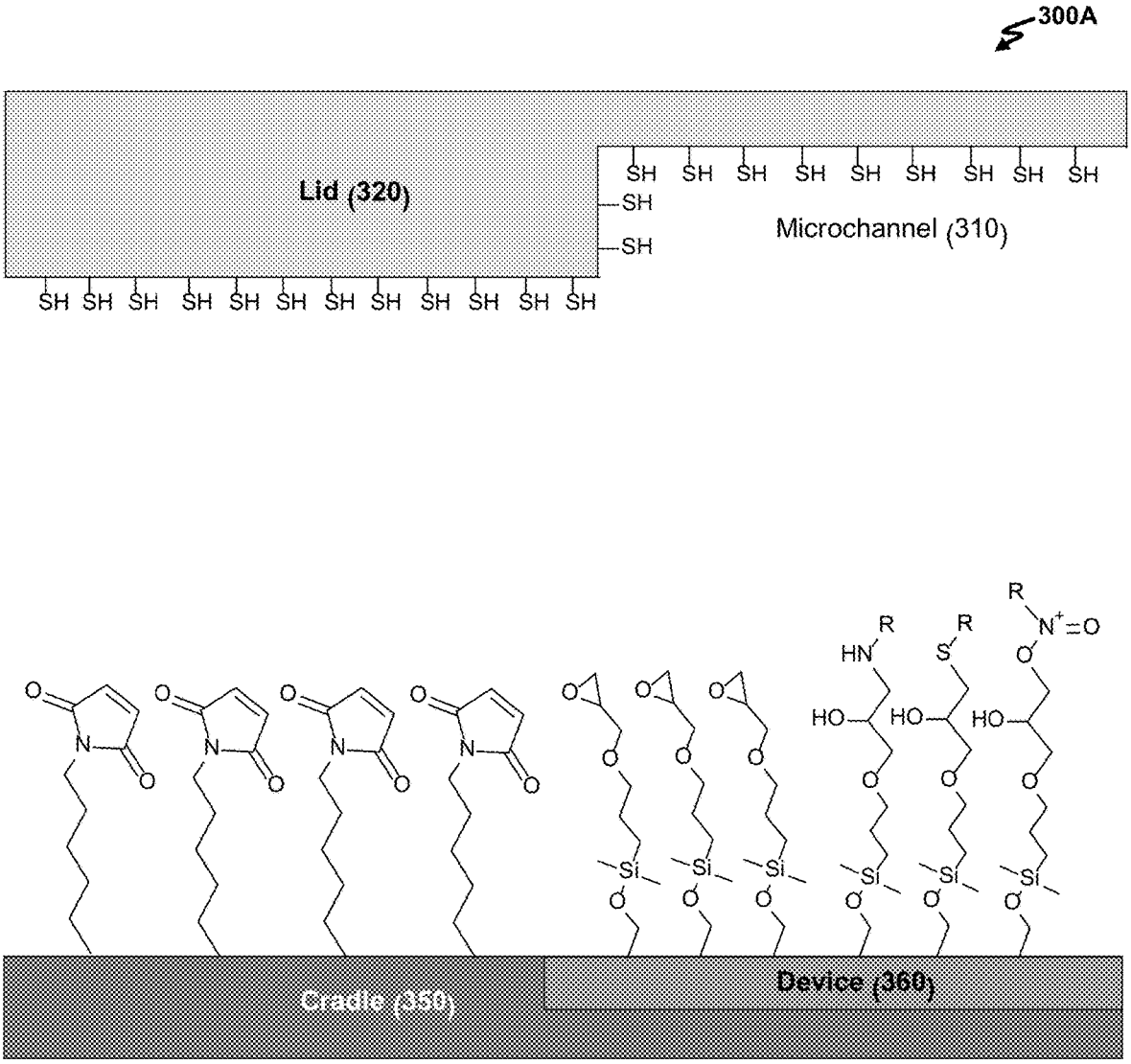
FIG. 3A-3C shows schematics of an exemplary microfluidic package having reactive groups. Provided are a cross-sectional view of a package 300A having a lid 320, a cradle 350, and a device 360 (FIG. 3A) and a cross-sectional view of another package 300B including an intermediate layer 370 (FIG. 3B). Also provided is a schematic of an exemplary reaction between a surface (of PMMA) and a reactive group (amino group of the amino thiol linking agent) to form a bonding surface (FIG. 3C).
Figure 3B:
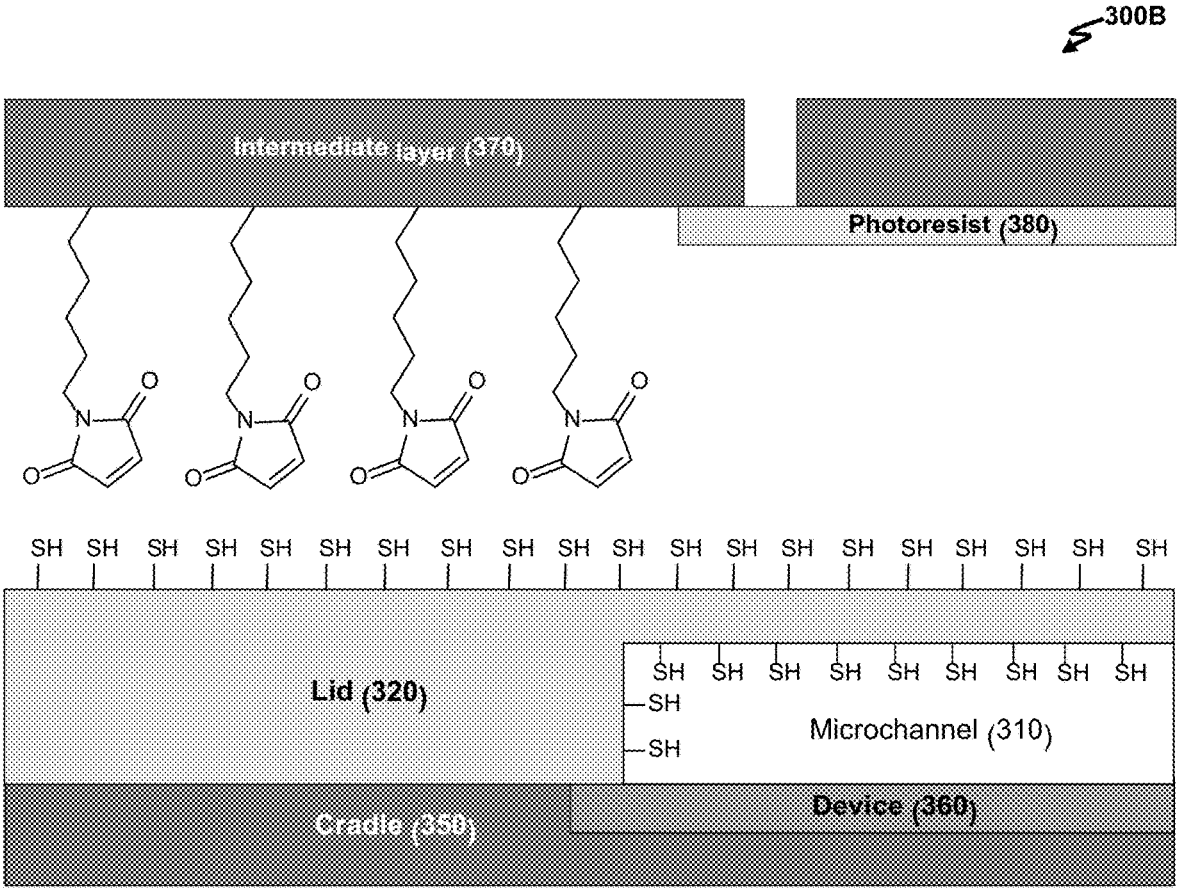

The package can include any useful structure (e.g., intermediate layer) and any useful reactive groups (e.g., any described herein). FIG. 3A-3B provides an exemplary microfluidic package having reactive groups. As can be seen, the package 300A includes a lid 320 having a recess (e.g., a microchannel 310), a cradle 350, and a device 360 (FIG. 3A). The lid is configured to provide the microchannel 310 disposed above the device 360 and to present a bonding surface having a first reactive group (e.g., a thiol group) configured to react with a second reactive group (e.g., a maleimido group) present on a bonding surface of the cradle 350.

The device 360 can include the same or different reactive groups, as compared to the cradle 350. In one non-limiting instance, the device includes a bonding surface having a reactive group configured to react with a reactive group of the lid. In another non-limiting instance, the device includes a reactive group that can be further reacted to present a protecting group (e.g., at an inactive area of the device). In yet another non-limiting instance, the device includes a reactive group that can be further reacted to present a capture probe (e.g., at an active area of the device).

The package can have any other useful structure, e.g., to provide fluidic connections to the device. In one non-limiting instance, the package 300B includes an intermediate layer 370 having a bonding surface on a lower surface. This bonding surface can include any useful reactive group (e.g., configured to react with one or more reactive groups present on a bonding surface of the lid, such as a bonding surface disposed on an upper surface of the lid 320). The intermediate layer can be formed from any useful polymer (e.g., polycarbonate, PMMA, etc.). In one non-limiting instance, the cradle and intermediate layer are formed from a polymer (e.g., a rigid polymer, such as polycarbonate, PMMA, etc.), the lid is formed from a microstructured polymer (e.g., including a molded polymer, such as OSTE or polynorbornene), and the device is formed from a microelectromechanical systems (MEMS) material (e.g., including silicon oxide, silicon nitride, etc.).

Figure 3C:
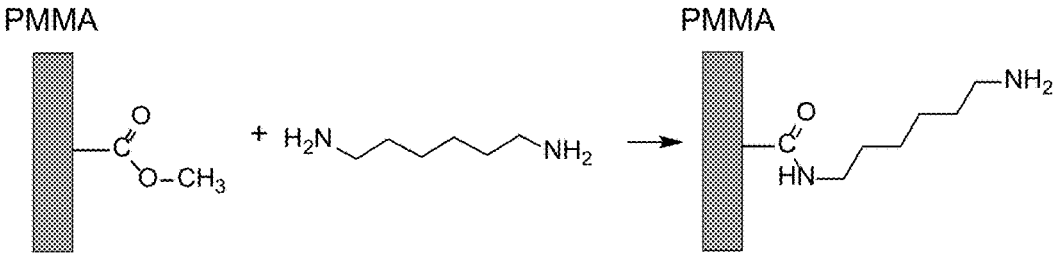

Although exemplary reactive groups are provided in FIG. 3A-3C, any useful reactive group can be employed on any of the bonding surfaces to provide a covalent bond upon aligning of the structures (e.g., lid, device, and/or cradle) of the package.

Figure 4A:
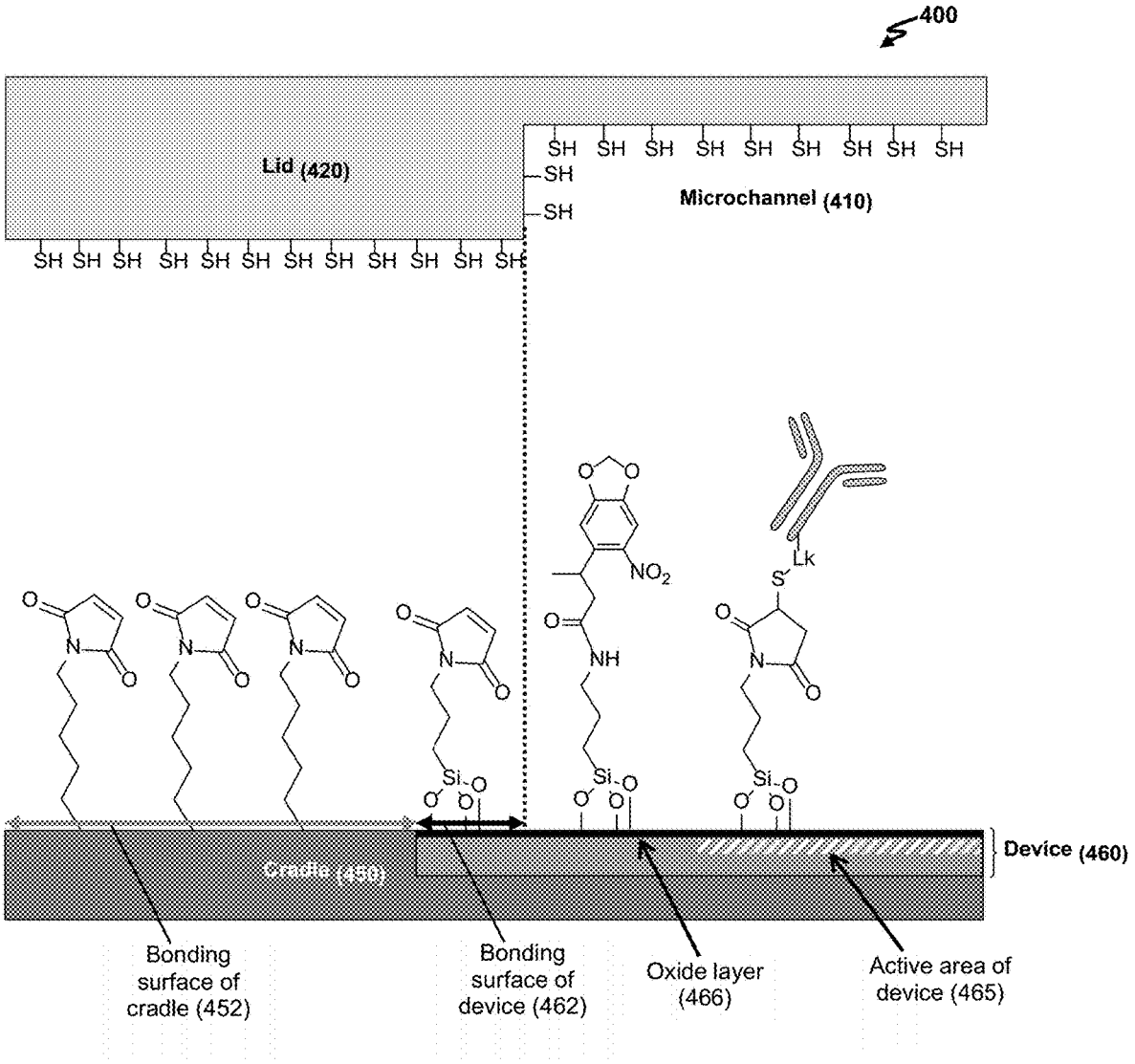
FIG. 4A-4B shows schematics of another exemplary microfluidic package having different reactive groups to form different bonding surfaces. Provided are a cross-sectional view of a package 400 having bonding surfaces disposed on the lid 420, the cradle 450, and device 460 (e.g., bonding surfaces 452,462) (FIG. 4A) and a cross-sectional view of another package 4000 having bonding surfaces disposed on the lid 4020, the cradle 4050, and device 4060 (e.g., bonding surfaces 4052,4062) (FIG. 4B).
Figure 4B:
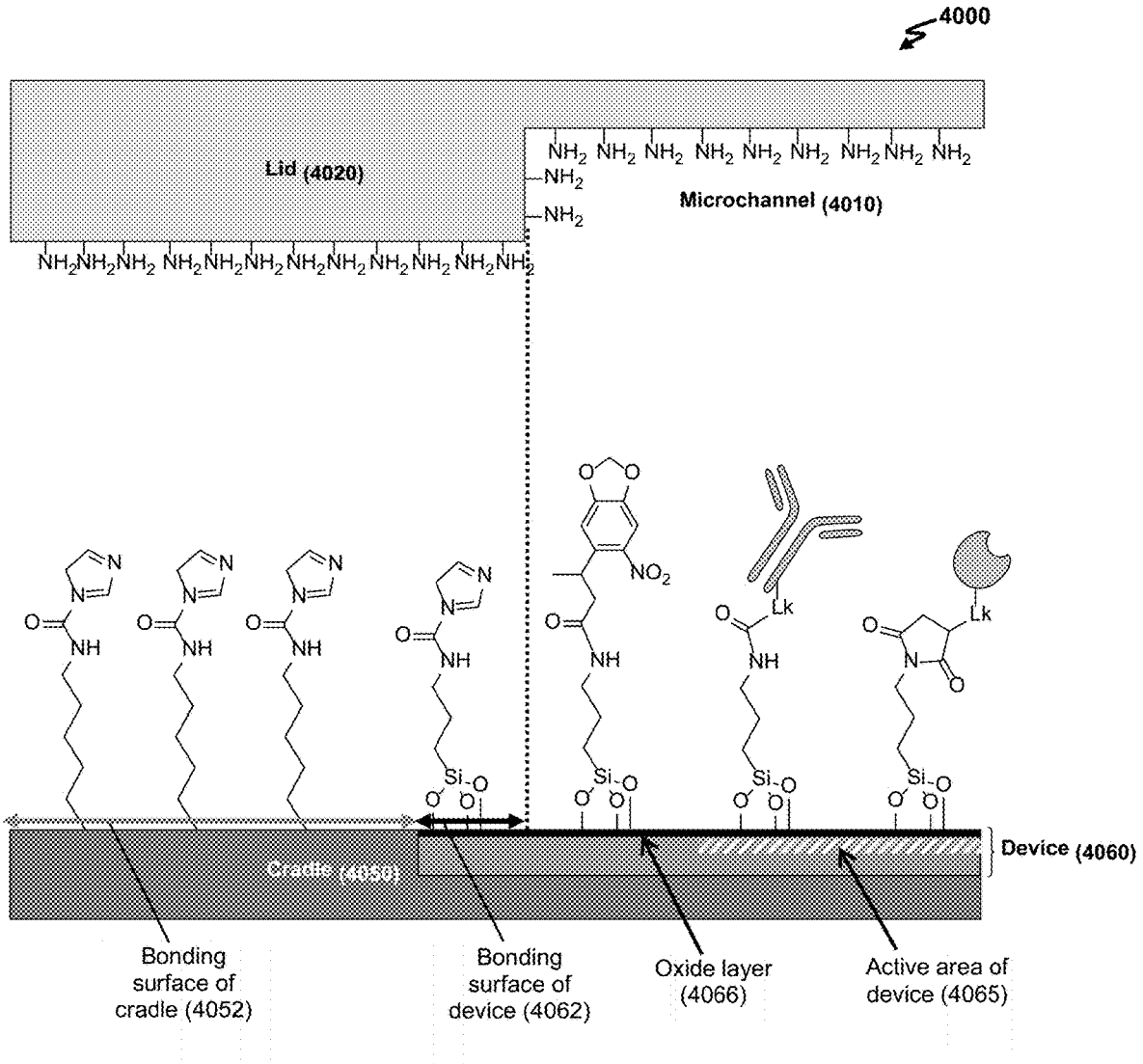

The package can employ any useful combination of reactive groups. FIG. 4A-4B shows another exemplary microfluidic package having different reactive groups to form different bonding surfaces. As can be seen, the package 400A includes a lid 420 having a recess (e.g., a microchannel 410), a cradle 450, and a device 460 (FIG. 4A). The lid is configured to provide the microchannel 410 disposed above the device 460 (e.g., an active area 465 of the device) and to present a bonding surface having a first reactive group (e.g., a thiol group) configured to react with a second reactive group (e.g., a maleimido group) present on a bonding surface 452 of the cradle 450. The lid can further include a bonding surface that extends to a portion of the device, upon alignment of the lid to the cradle and the device. As can be seen, the device includes a bonding surface 462 having a reactive group (e.g., a maleimido group) configured to react with the first reactive group of the lid 420.

The linking agent can be selected to have any useful reactive groups and linkers. In one instance, the linking agent can be $L^{1'}$-Lk-$L^{1''}$, in which each of $L^{1'}$ and $L^{1''}$ is, independently, a reactive group and Lk is a linker. For instance, a first reactive group of the linking agent (e.g., $L^{1'}$) can be selected to ensure reactivity with a surface provided by the cradle and/or device (e.g., a surface of the device 460 including an oxide layer 466), and the second reactive group of the linking agent (e.g., $L^{1''}$) can be selected to present a useful reactive group on a bonding surface (e.g., a maleimido reactive group on a bonding surface 452 of the cradle and a bonding surface 462 of the device).

FIG. 4B provides an exemplary package 4000 including other useful reactive groups. As can be seen, the package 4000 includes a lid 4020 having a recess (e.g., a microchannel 4010 disposed above an active area 4065 of the device), a cradle 4050 having a bonding surface 4052, and a device 4060 having a bonding surface 4062. The device also includes an oxide layer 4066 disposed above the inactive area (e.g., including a protecting group having a protected diol) and above the active area 4065 (e.g., including a capture probe). The lid includes a reactive group (e.g., an amino group) configured to react with the reactive group (e.g., a carbamido reactive group) of the cradle and/or the device.

Figure 5:
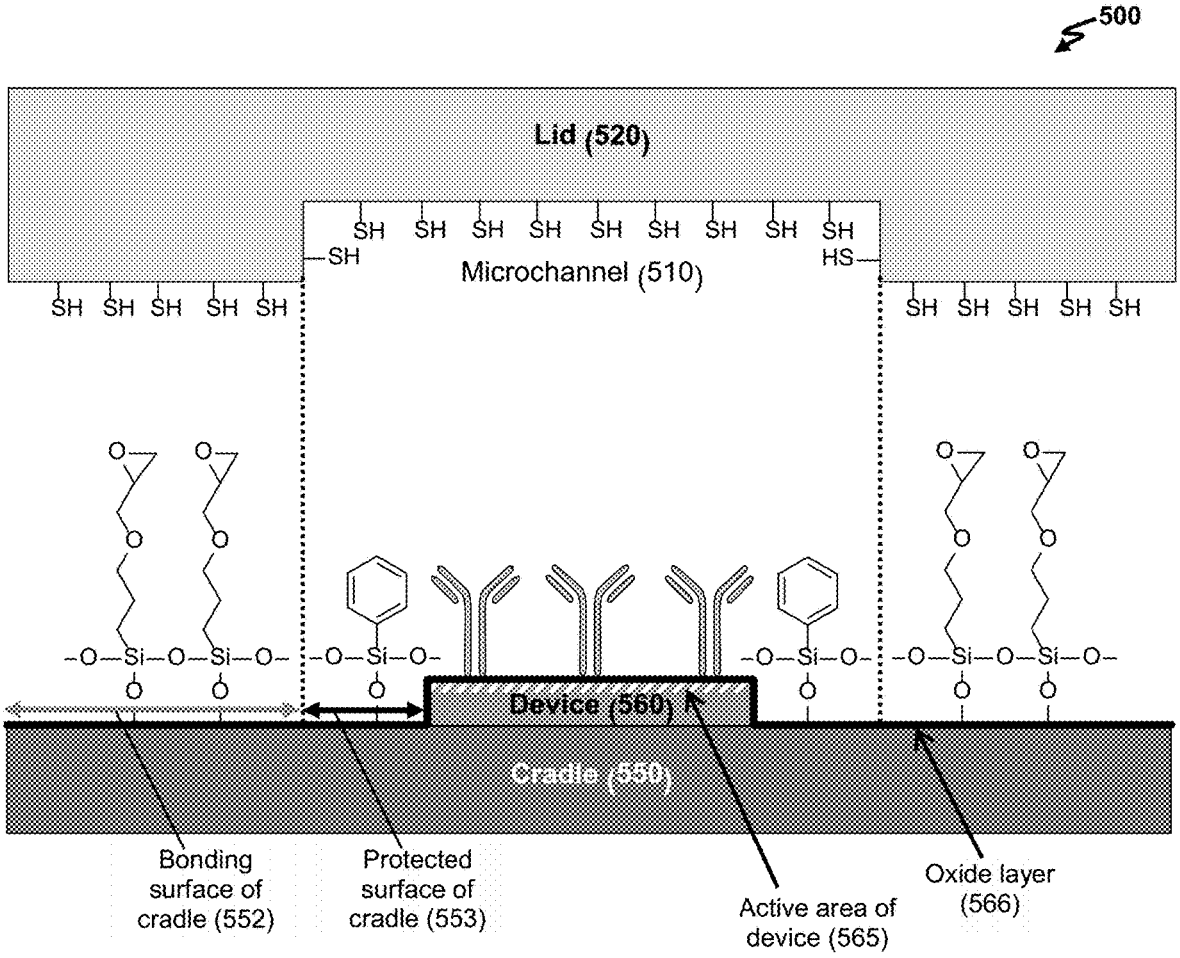
FIG. 5 show a schematic of another exemplary microfluidic package 500 having different reactive groups to form different bonding surfaces and protected surfaces.

FIG. 5 provides an alternative package 500 in which cradle 550 includes both a bonding surface 552 and a protected surface 553 (e.g., including a protecting group, such as any described herein). As can be seen, the package 500 includes a lid 520 having a recess (e.g., a microchannel 510 disposed above an active area 565 of the device), a cradle 550 having a bonding surface 552 and a protected surface 553, and a device 560. An oxide layer 566 can be optionally disposed on the surface of the device 560 and the cradle 550.

The packages can be formed in any useful manner. As described herein, the package can include any useful structure (e.g., lid, cover, pillar, cradle, device, and/or intermediate layer) that can each have any useful bonding surface. Alignment of structures and bonding (e.g., by exposure to a bonding temperature in proximity to the transition glass temperature of the structures) can result in fluidic seals between surfaces having reactive groups configured to react with each other. Exemplary methods can include providing such bonding surfaces having any useful reactive group (e.g., functionalizing a surface with a reactive group to provide a bonding surface), aligning such surfaces, and then attaching one bonding surface to another bonding surface, thereby forming a fluidic seal.

Figure 6A:
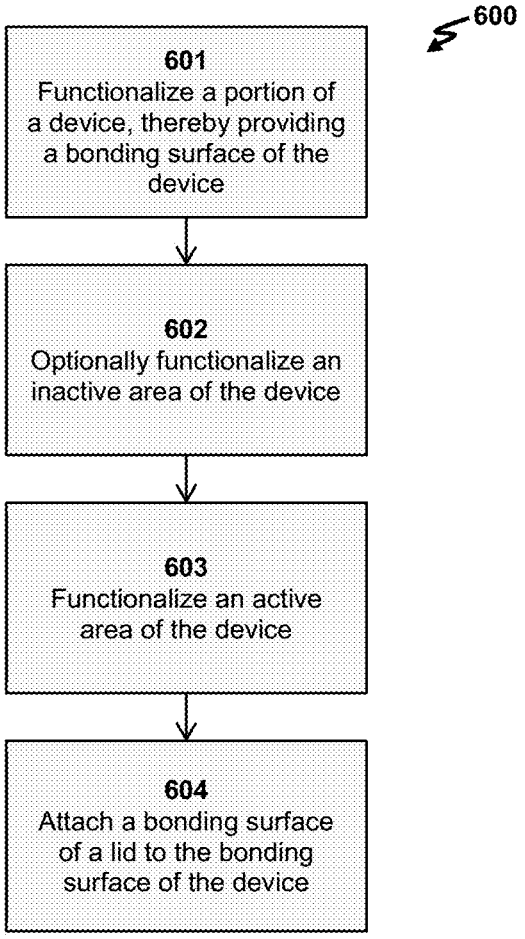
FIG. 6A-6B shows flowcharts of exemplary methods for making a microfluidic package. Provided are flowcharts for an exemplary method 600 to provide a bond between a lid and a device (FIG. 6A) and another exemplary method 6000 to provide a bond by employing at least two pillars (FIG. 6B).

FIG. 6A provides an exemplary method 600 including the steps of functionalizing 601 a portion of a device to provide a first bonding surface; optionally functionalizing 602 an inactive area of the device (e.g., with a protecting group); functionalizing 603 an active area of the device (e.g., with one or more capture probe and/or with one or more reactive groups configured to react with a capture probe); and attaching 604 a bonding surface of a lid to the bonding surface of the device (e.g., thereby forming a fluidic seal). Each of these steps can be performed in any useful order. In some instances, the method can include the step of functionalizing a lid to provide the bonding surface (e.g., with a reactive group configured to react with the reactive group present on the bonding surface of the device).

Figure 6B:
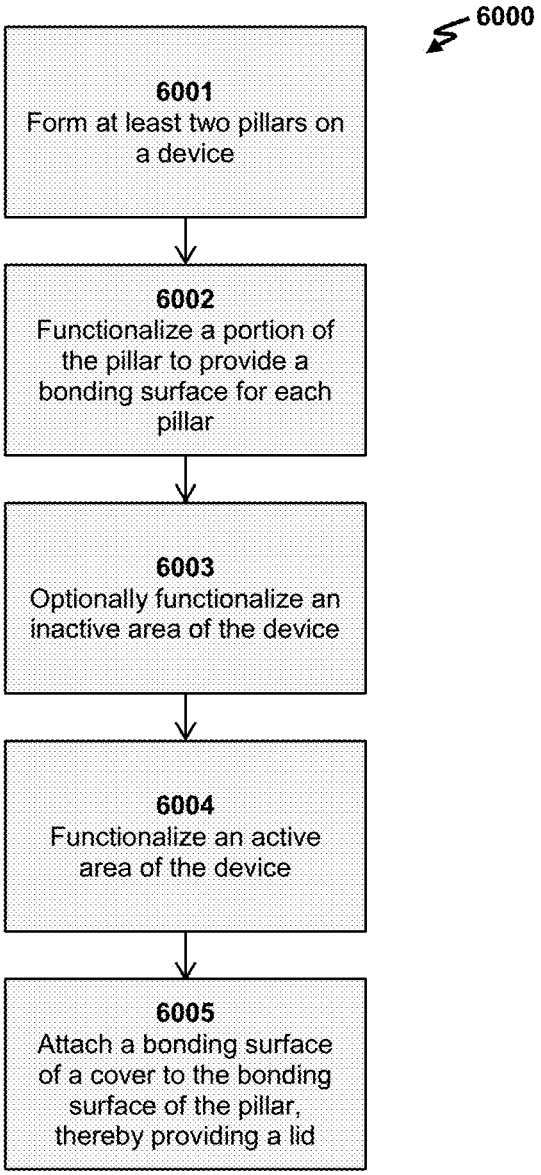

Other methods can include providing a plurality of pillars disposed on a surface of the device and/or cradle, and then bonding a cover to the pillars to form the lid. FIG. 6B provides an exemplary method 600 including the steps of forming 6001 at least two pillars on a surface of the device (e.g., an inactive area of the device); functionalizing 6002 a portion of the pillar to provide a bonding surface (e.g., including a first reactive group); optionally functionalizing 6003 an inactive area of the device (e.g., with a protecting group); functionalizing 6004 an active area of the device (e.g., with one or more capture probe and/or with one or more reactive groups configured to react with a capture probe); and attaching 6005 a bonding surface of a cover to the bonding surface of the pillar (e.g., thereby forming a lid and/or a fluidic seal). Each of these steps can be performed in any useful order. In some instances, the method can include the step of functionalizing a cover and/or a lid to provide a second bonding surface (e.g., including a second reactive group, where the second reactive group is configured to react with the first reactive group present on the pillar); and attaching the second bonding surface of the cover to the first bonding surface of the pillar, thereby providing a lid having a recess disposed above an active area of the device. In some embodiments, a fluidic seal is formed in the presence of the one or more capture probes.

Figure 7A:
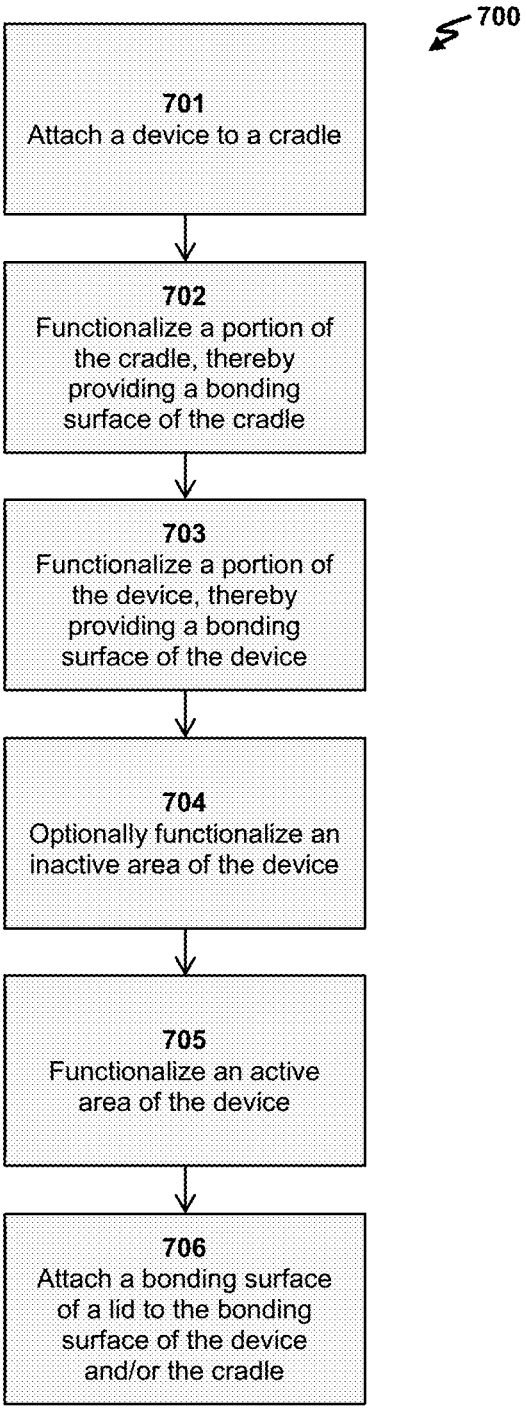
FIG. 7A-7B shows flowcharts of further exemplary methods for making a microfluidic package. Provided are flowcharts for an exemplary method 700 to provide a bond between a lid and a cradle (FIG. 7A) and another exemplary method 7000 to provide a bond by employing at least two pillars (FIG. 7B).

Further methods can include attaching the device to the cradle prior to bonding the lid. Such a method can be useful when the device requires delicate handling and/or precise alignment, such that support can be provided by employing a cradle. FIG. 7A provides an exemplary method 700 including the steps of attaching 701 a device to a cradle; functionalizing 702 a portion of a cradle to provide a first bonding surface; functionalizing 703 a portion of a device to provide a second bonding surface; optionally functionalizing 704 an inactive area of the device (e.g., with a protecting group); functionalizing 705 an active area of the device (e.g., with one or more capture probe and/or with one or more reactive groups configured to react with a capture probe); and attaching 706 a bonding surface of a lid to the bonding surface of the device and/or cradle (e.g., thereby forming a fluidic seal). Each of these steps can be performed in any useful order. In some instances, the method can include the step of functionalizing a lid to provide the bonding surface (e.g., with a reactive group configured to react with the reactive group present on the bonding surface of the device and/or cradle).

Figure 7B:
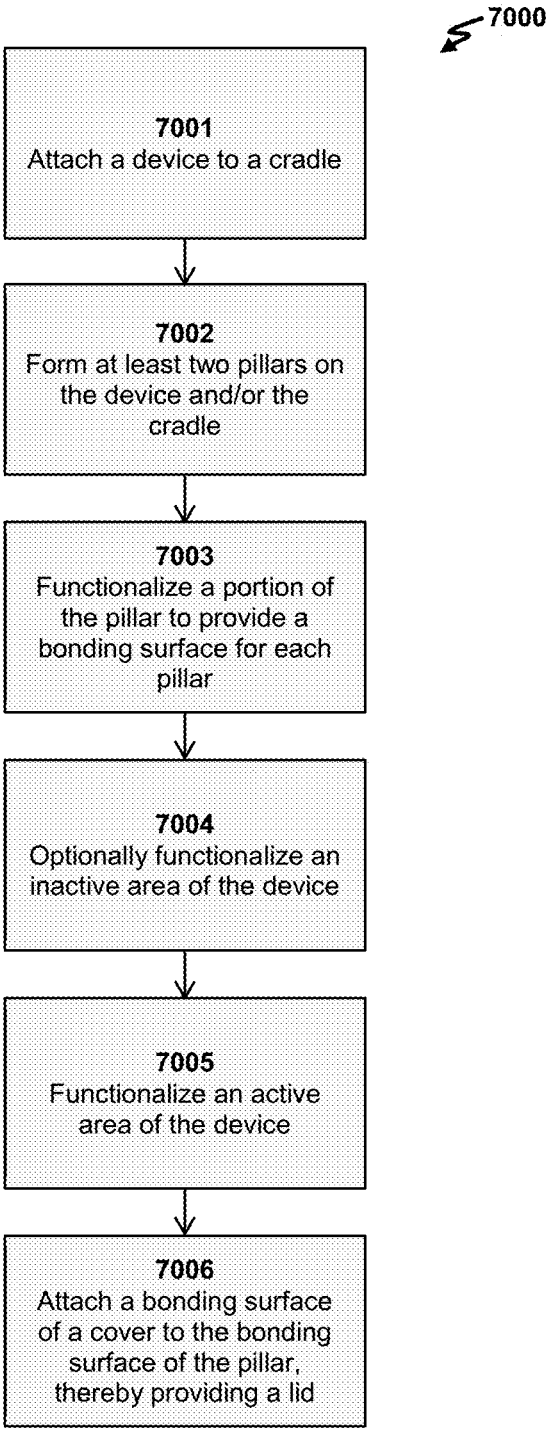

Methods can include use of pillars disposed upon a surface of a device attached to a cradle. FIG. 7B provides an exemplary method 7000 including the steps of attaching 7001 a device to a cradle; forming 7002 at least two pillars on surface of the device and/or the cradle; functionalizing 7003 a portion of the pillar to provide a bonding surface (e.g., including a first reactive group); optionally functionalizing 7004 an inactive area of the device (e.g., with a protecting group); functionalizing 7005 an active area of the device (e.g., with one or more capture probe and/or with one or more reactive groups configured to react with a capture probe); and attaching 7006 a bonding surface of a cover to the bonding surface of the pillar (e.g., thereby forming a lid and/or a fluidic seal). Each of these steps can be performed in any useful order. In some instances, the method can include the step of functionalizing a cover and/or a lid to provide a second bonding surface (e.g., including a second reactive group, where the second reactive group is configured to react with the first reactive group present on the pillar); and attaching the second bonding surface of the cover to the first bonding surface of the pillar, thereby providing a lid having a recess disposed above an active area of the device. In some embodiments, a fluidic seal is formed in the presence of the one or more capture probes.

Surfaces and Areas

The package can include any useful structures to provide any useful surfaces and/or areas. Exemplary structures include a lid, a device, a cradle, and/or an intermediate layer.

In particular embodiments, the device provides a detecting surface configured to bind to the target analyte and provide a detectable signal resulting from binding. The detecting surface can be the active area of the device including any useful sensor (e.g., a resonator) and/or any useful capture probe (e.g., any described herein) configured to bind one or more targets. In addition, the active area can be located in a region of a sensor to facilitate sensitive detection of any mass changes occurring in this area. In one instance, the active area is disposed in proximity to (e.g., above) the acoustic cavity. Furthermore, the active area can include a portion of the guide layer within the acoustic cavity. The device can also include an inactive area (e.g., lacking a capture probe).

Any structure herein can include a bonding surface having a reactive group capable of reacting with a reactive group present on another bonding surface. Exemplary bonding surfaces include those provided on a lower and/or upper surface of the lid, cradle, device, and/or intermediate layer. After alignment and bonding, such bonding surfaces can then be inactivated (e.g., by reaction with one or more linking agents having a protecting group) to reduce reactivity at the surface.

Functional Groups, Including Reactive Groups and Linking Agents

Figure 8A:
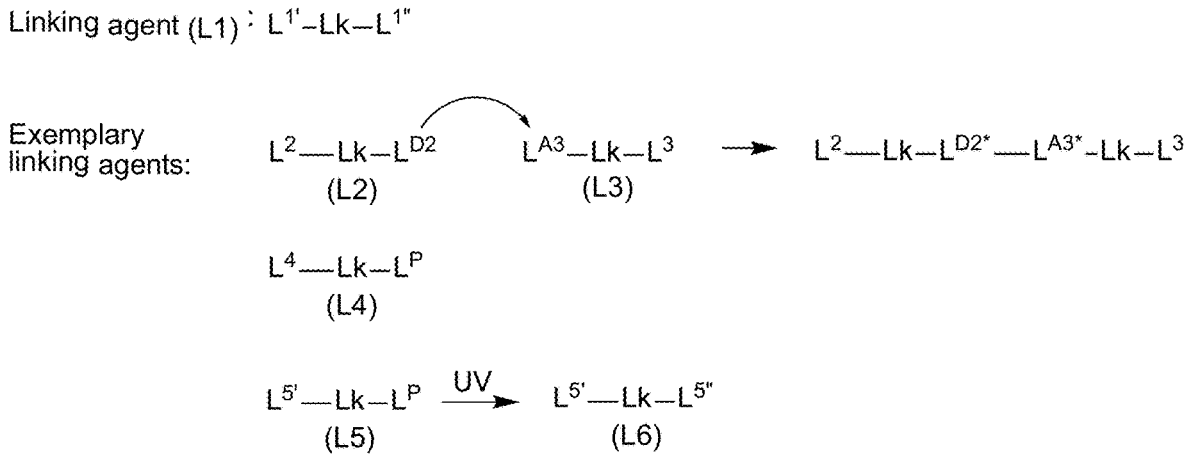
FIG. 8A-8D shows schematics of exemplary linking agents having reactive groups. Provided is a schematic showing exemplary linking agents L1-L6 (FIG. 8A), an exemplary reaction between first and second bonding surfaces 81,82 (FIG. 8B), and another exemplary reaction between first and second bonding surfaces 83,84 (FIG. 8C). Also provided is a cross-sectional view of a package 800 having bonding surfaces disposed on the lid 820, the cradle 850, and device 860 with various exposed reactive groups (FIG. 8D).

Functional groups can include any useful chemical group, such as a reactive group or a protecting group. Reactive groups are employed to provide a bond (e.g., a covalent bond) between surfaces present on different structures (e.g., the lid, cradle, device, and/or intermediate layer). Any useful linking agent can be employed to install a reactive group. FIG. 8A provides an exemplary linking agent $L^{1'}$-Lk-$L^{1''}$ (compound L1), where Lk is a linker and where each of $L^{1'}$ and $L^{1''}$ is, independently, a reactive group (e.g., a functional group that is one of a cross-linker group, a binding group, or a click-chemistry group, such as any described herein).

Figure 8B:
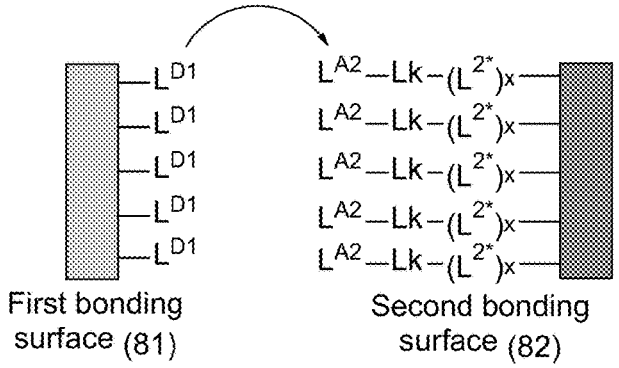

As seen in FIG. 8A, other exemplary linking agents include $L^2$-Lk-$L^{D2}$ (compound L2, in which $L^{D2}$ is a nucleophile configured to react with $L^{A3}$ in compound L3 and $L^2$ is any reactive group configured to react with a surface of a structure); $L^{A3}$-Lk-$L^3$ (compound L3, in which $L^{A3}$ is an electrophile configured to react with $L^{D2}$ in compound L2 and $L^3$ is any reactive group configured to react with a surface of a structure); $L^4$-Lk-$L^P$ (compound L4, in which $L^P$ is an protecting group and $L^4$ is any reactive group configured to react with a surface of a structure); $L^{5'}$-Lk-$L^P$ (compound L5, in which $L^P$ is an protecting group that provides a reactive group $L^{5''}$ upon UV exposure and $L^{5'}$ is any reactive group configured to react with a surface of a structure); and $L^{5'}$-Lk-$L^{5''}$ (compound L6, in which $L^{5''}$ is a reactive group provided upon UV exposure and configured to react with any other reactive group and $L^{5'}$ is any reactive group configured to react with a surface of a structure); One of the reactive groups can be employed to react with a surface of a structure, and the other reactive group extends from the surface to present a reaction site. As seen in FIG. 8B, a first reactive group ($L^{D1}$) can be provided on a first bonding surface 81, and a second reactive group ($L^{A2}$) can be provided on a second bonding surface 82. Reaction between the first and second reactive groups provides a covalent bond. The reactive group can be directly attached to a surface (e.g., as in reactive group -$L^{D1}$ provided on the bonding surface 81). Alternatively, the reactive group can be indirectly attached to the surface by way of a linker (e.g., any herein) and a reacted reactive group (e.g., as in reactive group -$L^{A2}$ attached to the bonding surface 82 by way of linker Lk and a reacted reactive group(s) $(L^{2*})$x, in which x is any useful number (e.g., an integer, such as 1, 2, 3, 4, or 5)).

Figure 8C:
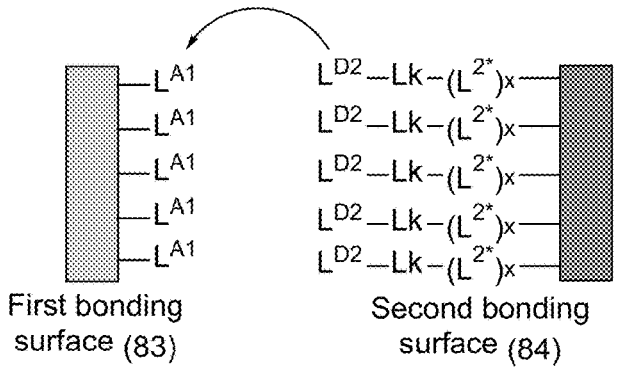

Any useful combination of reactive groups and linkers can be employed. As seen in FIG. 8C, a first reactive group ($L^{A1}$, an electrophile) can be provided on a first bonding surface 83, and a second reactive group ($L^{D2}$, a nucleophile) can be provided on a second bonding surface 84. Reaction between the first and second reactive groups provides a covalent bond.

Pairs of reactive groups can be chosen to facilitate any useful reaction between any bonding surfaces. In one instance, the first bonding surface includes a nucleophilic reactive group (e.g., an amino group, a thio group, a hydroxyl group, an anion, etc.), and the second bonding surface includes an electrophilic reactive group (e.g., an alkenyl group, an alkynyl group, a carbonyl group, an ester group, an imido group, an epoxide group, an amido group, a carbamido group, a cation, etc.).

Figure 8D:
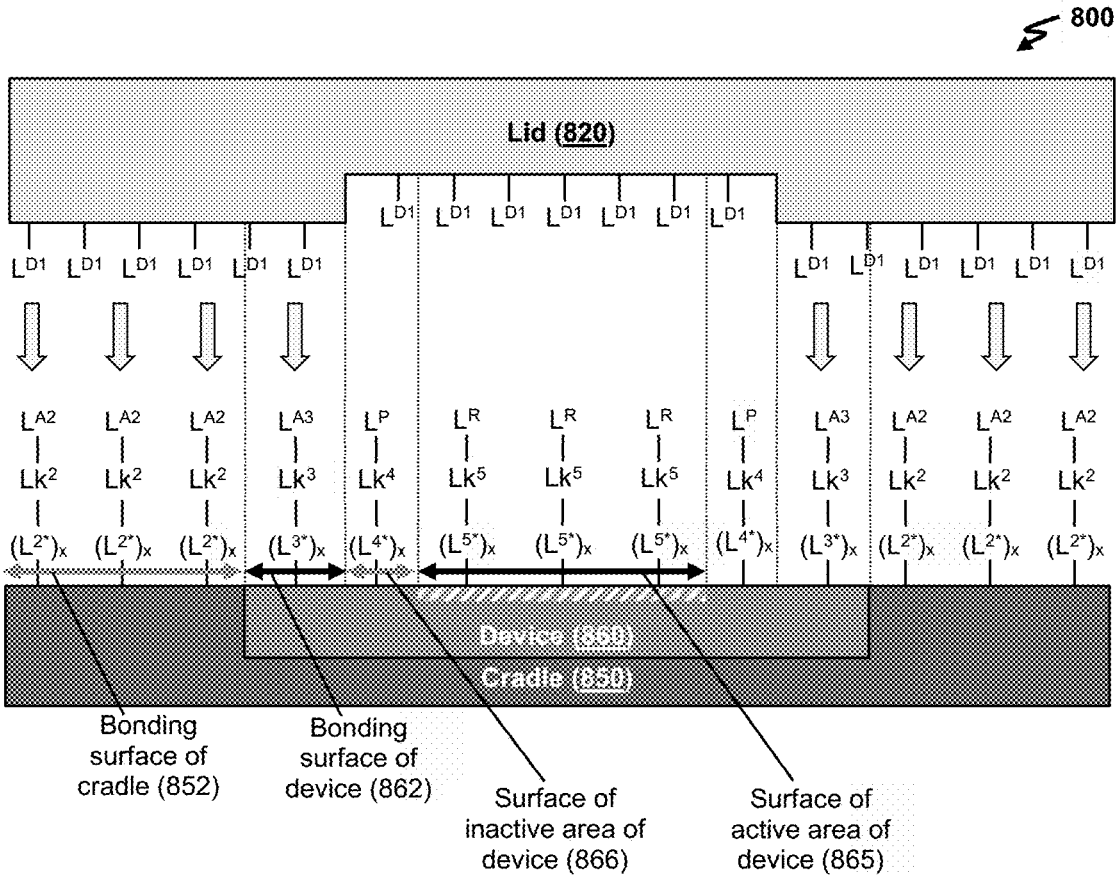

Bonding surfaces can include any useful combination of linking agents and/or reactive groups. As seen in FIG. 8D, the package 800 includes a lid 820, a cradle 850, and a device 860 presenting various types of surfaces: a bonding surface 852 disposed on a portion of the surface of the cradle, a bonding surface 862 disposed on a portion of the surface of the device, a functionalized surface 866 disposed on a portion of the inactive area of the device, and a functionalized surface 865 (e.g., a bonding surface) disposed on a portion of the active area of the device. Each type of surface can be functionalized to provide any useful chemical group (e.g., reactive group and/or protecting group).

In one embodiment, the lid 820 includes a reactive group $L^{D1}$ configured to react with reactive group $L^{A2}$ provided on the bonding surface 852 of the cradle and the reactive group $L^{A3}$ provided on the bonding surface 862 of the device. In one instance, $L^{D1}$ is a nucleophile, and each of $L^{A2}$ and $L^{A2}$ is, independently, the same or different electrophile. Any useful linking agent can be employed having any useful linker (e.g., any useful $Lk^2$, $Lk^3$, $Lk^4$, and $Lk^5$, which can be the same or different and can be any useful linker described herein) and any useful reactive group configured to react with a surface of a structure (e.g., any useful reactive group that, upon reaction, provides any reacted reactive group $-(L^{2*})_x$, $-(L^{3*})_x$, $-(L^{4*})_x$, and $-(L^{5*})_x$ attached to a surface, in which x is any useful number (e.g., an integer, such as 1, 2, 3, 4, or 5)). Reacted reactive groups (e.g., $-(L^{2*})_x$-) is a group arising after a reactive group (e.g., $-(L^2)_x$) forms a bond with a surface.

The surface(s) of the device is functionalized to provide a protected surface and/or a reactive surface. In one embodiment, the device includes a protected surface disposed on a portion of a surface of the device (e.g., on the inactive area of the device). As seen in FIG. 8D, the device includes a protecting group $L^P$ provided on a surface 866 of the inactive area of the device. $L^P$ can be any chemical group configured to reduce binding (e.g., non-specific binding) of an agent (e.g., a target analyte) to the surface of the device. $L^P$ can be attached directly to the surface or indirectly by way of a linker $Lk^4$.

In another embodiment, the device includes a functionalized surface disposed on a portion of a surface of the device (e.g., on the active area of the device). As seen in FIG. 8D, the device includes a group $L^R$ provided on a surface 865 of the inactive area of the device. $L^R$ can be a reactive group configured to react with a capture probe, or $L^R$ itself can be a capture probe. $L^R$ can be attached directly to the surface or indirectly by way of a linker $Lk^5$.

Exemplary reactive groups include any chemical group configured to form a bond. In general, a first chemical group reacts with a second chemical group to form a bond (e.g., a covalent bond), in which the first and second chemical groups form a reactive pair.

In one instance, the reactive group is a cross-linker group. In another non-limiting instance, the reactive pair is a cross-linker reaction pair, which includes a first cross-linker group and a second cross-linker group that reacts with that first cross-linker group. Exemplary cross-linker groups and cross-linker reaction pairs include those for forming a covalent bond between a carboxyl group (e.g., —$CO_2H$) and an amino group (e.g., —$NH_2$); or between an imido group (e.g., maleimido or succinimido) and a thiol group (e.g., —SH); or between an epoxide group and a thiol group (e.g., —SH); or between an epoxide group and an amino group (e.g., —$NH_2$); or between an ester group (e.g., —$CO_2R$, in which R is an organic moiety, such as optionally substituted alkyl, aryl, etc.) and an amino group (e.g., —$NH_2$); or between an carbamido group (e.g., —NHC(O)Het, where Het is a N-containing heterocyclyl) and an amino group (e.g., —$NH_2$); or between a phospho group (e.g., —$P(O)(OH)_2$) and an amino group (e.g., —$NH_2$), such as 1-ethyl-3-(3-dimethylaminopropyl)carbodiimide (EDC) and dicyclohexylcarbodiimide (DCC), optionally used with N-hydroxysuccinimide (NHS) and/or N-hydroxysulfosuccinimide (sulfo-NHS). Other cross-linkers include those for forming a covalent bond between an amino group (e.g., —$NH_2$) and a thymine moiety, such as succinimidyl-[4-(psoralen-8-yloxy)]-butyrate (SPB); a hydroxyl group (e.g., —OH) and a sulfur-containing group (e.g., free thiol, —SH, sulfhydryl, cysteine moiety, or mercapto group), such as p-maleimidophenyl isocyanate (PMPI); between an amino group (e.g., —$NH_2$) and a sulfur-containing group (e.g., free thiol, —SH, sulfhydryl, cysteine moiety, or mercapto group), such as succinimidyl 4-(p-maleimidophenyl)butyrate (SMPB) and/or succinimidyl 4-(N-maleimidomethyl)cyclohexane-1-carboxylate (SMCC); between a sulfur-containing group (e.g., free thiol, —SH, sulfhydryl, cysteine moiety, or mercapto group) and a carbonyl group (e.g., an aldehyde group, such as for an oxidized glycoprotein carbohydrate), such as N-beta-maleimidopropionic acid hydrazide-trifluoroacetic acid salt (BMPH), 3-(2-pyridyldithio)propionyl hydrazide (PDPH), and/or a 3-(2-pyridyldithio)propionyl group (PDP); and between a maleimide-containing group and a sulfur-containing group (e.g., free thiol, —SH, sulfhydryl, cysteine moiety, or mercapto group). Yet other cross-linkers include those for forming a covalent bond between two or more unsaturated hydrocarbon bonds, e.g., mediated by radical polymerization, such as a reaction of forming a covalent bond between a first alkene group and a second alkene group (e.g., a reaction between acrylate-derived monomers to form a polyacrylate, polyacrylamide, etc.).

In another instance, the reactive group is a binding group. In another non-limiting instance, the reactive pair is a binding reaction pair, which includes a first binding group and a second binding group that reacts with that first binding group. Exemplary binding groups and binding reaction pairs include those for forming a covalent bond between biotin and avidin, biotin and streptavidin, biotin and neutravidin, desthiobiotin and avidin (or a derivative thereof, such as streptavidin or neutravidin), hapten and an antibody, an antigen and an antibody, a primary antibody and a secondary antibody, and lectin and a glycoprotein.

In yet another instance, the reactive group is a click-chemistry group. In another non-limiting instance, the reactive pair is a click-chemistry reaction pair, which includes a first click-chemistry group and a second click-chemistry group that reacts with that first click-chemistry group. Exemplary click-chemistry groups include, e.g., a click-chemistry group, e.g., one of a click-chemistry reaction pair selected from the group consisting of a Huisgen 1,3-dipolar cycloaddition reaction between an alkynyl group and an azido group to form a triazole-containing linker; a Diels-Alder reaction between a diene having a 47 electron system (e.g., an optionally substituted 1,3-unsaturated compound, such as optionally substituted 1,3-butadiene, 1-methoxy-3-trimethylsilyloxy-1,3-butadiene, cyclopentadiene, cyclohexadiene, or furan) and a dienophile or heterodienophile having a 27 electron system (e.g., an optionally substituted alkenyl group or an optionally substituted alkynyl group); a ring opening reaction with a nucleophile and a strained heterocyclyl electrophile; and a splint ligation reaction with a phosphorothioate group and an iodo group; and a reductive amination reaction with an aldehyde group and an amino group.

Exemplary reactive groups include an amino (e.g., $—NH_2$), a thio (e.g., a thioalkoxy group or a thiol group), a hydroxyl, an ester (e.g., an acrylate), an imido (e.g., a maleimido or a succinimido), an epoxide, an isocyanate, an isothiocyanate, an anhydride, an amido, a carbamido (e.g., a urea derivative), an azide, an optionally substituted alkynyl, or an optionally substituted alkenyl.

Exemplary linker groups include any moiety, including any useful subunit, which when repeated, provides a polymer having any useful property. Exemplary linker groups include a bond (e.g., a covalent bond), optionally substituted alkylene, optionally substituted heteroalkylene (e.g., poly (ethylene glycol)), optionally substituted arylene, and optionally substituted heteroarylene. Yet other exemplary linker groups are those including an ethylene glycol group, e.g., $—OCH_2CH_2—$, including a poly(ethylene glycol) (PEG) group $—(OCH_2CH_2)_n—$, a four-arm PEG group (such as $C(CH_2O(CH_2CH_2O)_n—)_4$ or $C(CH_2O(CH_2CH_2O)_nCH_2—)_4$ or $C(CH_2O(CH_2CH_2O)_nCH_2CH_2—)_4$ or $C(CH_2O(CH_2CH_2O)_nCH_2CH_2NHC(O)CH_2CH_2)_4C(CH_2O(CH_2CH_2O)_nCH_2C(O)O)_4$), an eight-arm PEG group (such as $—(OCH_2CH_2)_nO[CH_2CHO((CH_2CH_2O)_n—)CH_2O]_6(CH_2CH_2O)_n$ or $—CH_2(OCH_2CH_2)_nO[CH_2CHO((CH_2CH_2O)_nCH_2)CH_2O]_6(CH_2CH_2O)_nCH_2—$ or $—CH_2CH_2(OCH_2CH_2)_nO[CH_2CHO((CH_2CH_2O)_nCH_2CH_2)CH_2O]_6(CH_2CH_2O)_nCH_2CH_2—R(O(CH_2CH_2O)_n—)_8$ or $R(O(CH_2CH_2O)_nCH_2—)_8$ or $R(O(CH_2CH_2O)_nCH_2CH_2—)_8$, in which R includes a tripentaerythritol core), or a derivatized PEG group (e.g., methyl ether PEG (mPEG), a propylene glycol group, etc.); including dendrimers thereof, copolymers thereof (e.g., having at least two monomers that are different), branched forms thereof, start forms thereof, comb forms thereof, etc., in which n is any useful number in any of these (e.g., any useful n to provide any useful number average molar mass $M_n$).

Exemplary linking agents can include a poly(ethylene glycol) group (e.g., a multivalent poly(ethylene glycol) precursor having a reactive functional group, such as an amino group, an ester group, an acrylate group, a hydroxyl group, a carboxylic acid group, etc.), such as eight arm-PEG amine (8-arm PEG-$NH_2$, e.g., catalog nos. PSB-811, PSB-812, or PSB-814 available from Creative PEGWorks, Chapel Hill, N.C.) or an eight-arm PEG succinimidyl ester (such as 8-arm PEG succinimidyl NHS ester or 8-arm PEG-SCM (succinimidyl carboxyl methyl ester), e.g., catalog nos. PSB-841, PSB-842, or PSB-844 available from Creative PEGWorks) or an eight-arm PEG vinylsulfone or an eight-arm PEG hydroxyl or a linear PEG thiol or a linear PEG hydroxyl or poly(ethylene glycol diacrylate) (PEG-DA) or triethylene glycol acrylate (TEGA) or 2-carboxyethyl acrylate (CEA) or 2-hydroxyethylacrylate (HEA), as well as copolymers thereof and/or combinations thereof; an amino acid (e.g., a poly(amino acid) precursor or a protein, such as a poly(lysine) precursor, a poly(arginine) precursor, lysozyme, avidin, or albumin); a glycerol group (e.g., a poly(glycerol) precursor); a vinyl group (e.g., a poly(vinyl) precursor or a poly(vinyl alcohol) precursor); a hydroxyacid group (e.g., a poly(lactic acid) precursor, a poly(glycolic acid) precursor, or a poly(lactic-co-glycolic acid) precursor); an acrylate group (e.g., a poly(acrylic acid) precursor or a poly(methacrylic acid) precursor); a silyl ether group (e.g., a poly(silyl ether) precursor); an olefin group (e.g., a poly (acetylene) precursor); and/or an aromatic group (e.g., a poly(pyrrole) precursor, a poly(aniline) precursor, or a poly (thiophene) precursor).

Other exemplary, non-limiting linking agents include 3-aminopropyltrimethoxysilane (3-APTMS); (R,S)-1-(3,4-(methylenedioxy)-6-nitrophenyl)ethyl chloroformate (MenPOC); 1-(6-nitrobenzo[d][1,3]dioxol-5-yl)ethyl (3-(trimethoxysilyl)propyl)carbamate; phenyltrichlorosilane (PTCS); an epoxysilane; sulfo-NHS-acetate; 1-(3-(trimethoxysilyl)propyl)-1H-pyrrole-2,5-dione; 3-glycidoxypropyltrimethoxysilane (3-GPTMS); N-(3-(trimethoxysilyl)propyl)-1H-imidazole-1-carboxamide; N-(6-aminohexyl)-1H-imidazole-1-carboxamide; anhydrides; isocyanotopropyltrimethoxysilane (IPTMS); isocyanates; isothiocyanates; and maleimides.

Protecting groups are employed to protect a reactive group and/or to provide reduced reactivity (e.g., binding) of an agent (e.g., a capture probe). Exemplary protecting groups include any described herein, including optionally substituted aryl groups, a poly(ethylene glycol) group, UV-labile groups, etc.).

Material, Including Polymers and Copolymers

Any structure herein (e.g., a lid, cradle, device, intermediate layer, coating for any of these, interleaving layer for any of these, etc.) can be formed from any useful material. In one instance, the device includes a semiconductor material (e.g., silicon, silicon oxide, silicon nitride, etc.). In another instance, the lid, cradle, and/or intermediate layer includes a polymer (e.g., a functionalized polymer).

Exemplary polymers includes polynorbornene, off-stoichiometry thiol-ene (OSTE), off-stoichiometric thiol-ene-epoxy (OSTE+), cyclic olefin polymer (COP), cyclic olefin copolymer (COC), polymethylmethacrylate (PMMA), polycarbonate (PC), poly(bisphenol A carbonate), poly(propylene carbonate), polystyrene (PS), styrene copolymer, polyethylene terephthalate (PET, e.g., biaxially-oriented PET or bo-PET), an acrylic polymer, poly(dimethylsiloxane) (PDMS), polyethylene terephthalate glycol (PETG), polyethylene (PE, such as branched homo-polymer PE), polyvinylchloride (PVC), polyimide (PI), polypropylene (PP), polyester, polytetrafluoroethylene (PTFE), poly(4-methyl-1-pentene), silicone, and combinations or co-polymers thereof. Polymers can include any useful additive, such as, e.g., photoinitiators, curing agents, fillers (e.g., mica, talc, or calcium carbonate), plasticizers (e.g., dioctyl phthalate), heat stabilizers (e.g., organo-tin compounds), antioxidants (e.g., phenols or amines), and/or UV stabilizers (e.g., benzophenones or salicylates).

The device can optionally include an oxide layer. In some embodiments, the oxide layer can include silicon dioxide, magnesium oxide, hafnium dioxide, titanium dioxide, tantalum dioxide, or aluminum oxide.

The pillar can be formed from any useful material, e.g., a polymer (e.g., any described herein), a resist (e.g., a photoresist), a resin (e.g., an epoxy resin), etc., and by employing any useful method, including molecular beam epitaxy (MBE), hydride vapor phase epitaxy (HVPE), physical vapor deposition (PVD), chemical vapor deposition (CVD), atomic layer deposition (ALD), a metalorganic chemical vapor deposition (MOCVD) process, sputtering, spin-on coating, or another suitable formation method.

Analytes, Including Targets and Markers

The present package can be used to determine any useful analyte (e.g., targets or markers). Exemplary analytes include a virus, a bacterium, a pathogen, a cell (e.g., a eukaryotic cell, a prokaryotic cell, a spore, as well as whole cells or fragments thereof), a protein (e.g., a prion, a membrane protein, a peptide marker, a hormone, etc.), a modified protein (e.g., a glycosylated, aminated, peglylated, phosphorylated, acetylated, truncated, or mutated protein), a peptide, a nucleic acid (including a nucleotide or a polynucleotide, e.g., DNA, RNA, mRNA, rTRNA, microRNA, etc. for detecting one or more alleles, pathogens, single nucleotide polymorphisms, mutations, etc.), a modified nucleic acid (e.g., a mutated nucleic acid), a cytokine (e.g., TNF-α, IL-12, or IL-10), a prion, etc., as well as fragments or extracts of any of these. Additional analytes, targets, markers, and capture probes are described in U.S. Pat. No. 8,709,791, which is incorporated herein by reference in its entirety.

In some instances, the target includes a virus (e.g., animal, plant, fungal, and/or bacterial viruses), including Adenoviridae (e.g., adenovirus), Arenaviridae (e.g., Machupo virus), Astroviridae, Bunyaviridae (e.g., Hantavirus, Andes virus, Sin Nombre virus, and Rift Valley fever virus), Caliciviridae (e.g., Norwalk virus), Coronaviridae, Filoviridae (e.g., Ebola virus and Marburg virus), Flaviviridae (e.g., Japanese encephalitis virus, dengue virus, West Nile virus, and Yellow fever virus), Hepadnaviridae (e.g., hepatitis A virus, hepatitis B virus, and hepatitis C virus), Herpesviridae (e.g., Epstein-Barr virus and herpes simplex viruses, such as HSV-1 and HSV-2), Orthomyxoviridae (e.g., influenza viruses, such as influenza virus A (e.g., subtype H5N1, H3N2, or H1N1), influenza virus B, and influenza virus C), Papillomaviridae (e.g., human papilloma virus), Papovaviridae (e.g., papilloma viruses and polyomaviruses, such as Simian virus 40 (SV40)), Paramyxoviridae (e.g., respiratory syncytial virus, measles virus, mumps virus, and parainfluenza virus), Parvoviridae (e.g., adeno-associated virus), Picornaviridae (e.g., polioviruses, enteroviruses, rhinoviruses, hepatoviruses, and coxsackieviruses), Polyomaviridae, Poxviridae (e.g., variola viruses), Reoviridae (e.g., rotaviruses), Retroviridae (e.g., human T cell lymphotropic viruses (HTLV) and human immunodeficiency viruses (HIV), such as HIV-1 and HIV-2), Rhabdoviridae (e.g., rabies virus), and Togaviridae (e.g., encephalitis viruses and rubella virus).

Other exemplary targets include a bacterium, such as *Bacillus* (e.g., *B. anthracis*), Enterobacteriaceae (e.g., *Salmonella, Escherichia coli, Yersinia pestis, Klebsiella*, and *Shigella*), *Yersinia* (e.g., *Y. pestis* or *Y. enterocolitica*), *Staphylococcus* (e.g., *S. aureus*), *Streptococcus, Gonorrheae, Enterococcus* (e.g., *E. faecalis*), *Listeria* (e.g., *L. monocytogenes*), *Brucella* (e.g., *B. abortus, B. melitensis*, or *B. suis*), *Vibrio* (e.g., *V. cholerae*), *Corynebacterium diphtheria, Pseudomonas* (e.g., *P. pseudomallei* or *P. aeruginosa*), *Burkholderia* (e.g., *B. mallei* or *B. pseudomallei*), *Shigella* (e.g., *S. dysenteriae*), *Rickettsia* (e.g., *R. rickettsii, R. prowazekii*, or *R. typhi*), *Francisella tularensis, Chlamydia psittaci, Coxiella burnetii, Mycoplasma* (e.g., *M. mycoides*), etc.; allergens, such as peanut dust, mycotoxins, mold spores, or bacterial spores such as *Clostridium botulinum* and *C. perfringens*; toxins, such as ricin, mycotoxin, tetrodotoxin, anthrax toxin, botulinum toxin, staphylococcal entertoxin B, or saxitoxin; a protozoon, such as *Cryptosporidium parvum, Encephalitozoa, Plasmodium, Toxoplasma gondii, Acanthamoeba, Entamoeba histolytica, Giardia lamblia, Trichomonas vaginalis, Leishmania*, or *Trypanosoma* (e.g., *T. brucei* and *T. Cruzi*); a helminth, such as cestodes (tapeworms), trematodes (flukes), or nematodes (roundworms, e.g., *Ascaris lumbricoides, Trichuris trichiura, Necator americanus*, or *Ancylostoma duodenale*); a parasite (e.g., any protozoa or helminths described herein); a fungus, such as *Aspergilli, Candidae, Coccidioides immitis*, and *Cryptococci*; an environmental contaminant; a water additive; an agricultural marker; a nucleic acid (e.g., oligonucleotides, polynucleotides, nucleotides, nucleosides, molecules of DNA, or molecules of RNA, including a chromosome, a plasmid, a viral genome, a primer, or a gene); a protein (e.g., a glycoprotein, a metalloprotein, an enzyme, a prion, or an immunoglobulin); a metabolite; a sugar; a lipid; a lipopolysaccharide; a salt; or an ion. Targets also include food-borne pathogens, such as *Salmonella* (e.g., *Salmonella Typhimurium*), pathogenic *E. coli* (e.g., O157:H7), *Bacillus* (e.g., *B. cereus*), *Clostridium botulinum, Listeria monocytogenes, Yersinia* (e.g., *Y. enterocolitica*), *Norovirus* (e.g., Norwalk virus), *Shigella, Staphylococcus aureus, Toxoplasma gondii, Vibrio* (e.g., *V. vulnificus, V. cholera, V parahaemolyticus*), *Campylobacter jejuni*, and *Clostridium perfringens*; and weaponized pathogens, such as *Bacillus anthracis, Yersinia pestis, Francisella tularensis, Brucella* (e.g., *B. suis*), *Burkholderia mallei, Burkholderia pseudomallei, Shigella, Clostridium botulinum*, Variola (e.g., *V. major*), Filoviridae (e.g., Ebola virus and Marburg virus), Arenaviridae (e.g., Lassa virus and Machupo virus), *Clostridium perfringens*, any food-borne pathogen (e.g., *Salmonella* species, *Escherichia coli* O157:H7, or *Shigella*), *Chlamydia psittaci, Coxiella burnetii, Staphylococcal aureus, Rickettsia* (e.g., *R. prowazekii* or *R. rickettsii*), Alphavirus (e.g., Venezuelan equine encephalitis virus, eastern equine encephalitis virus, or western equine encephalitis virus), *Vibrio cholerae, Cryptosporidium parvum*, Henipavirus (e.g., Nipah virus), Bunyaviridae (e.g., Hantavirus or Rift Valley fever virus), Flaviviridae (e.g., Japanese encephalitis virus and Yellow fever virus), and *Coccidioides* spp.

Capture Probes

Any useful capture probes can be used in combination in the present application. The capture probe can directly or indirectly bind the analyte of interest. Further, multiple capture probes (e.g., optionally employed with one or more linkers and/or binding agents) can be used to bind the target analyte and provide a detectable signal for such binding. For instance, multiple capture probes can be used for a sandwich assay, which requires at least two capture probes and can optionally include a further capture probe that includes a label allowing for detection.

Selective binding by a capture probe can be detected by any useful signal, such as an optical, piezoelectric, electrical, thermal, acoustic, and/or mechanical signal. In one non-limiting instance, the signal is an electrical readout, an optical emission, a frequency shift, a phase shift, a phase transition, mechanical deformation, bending, and/or a temperature shift.

Exemplary capture probes include one or more of the following: a protein that binds to or detects one or more targets (e.g., an antibody including monoclonal or polyclonal forms thereof, an affibody, an enzyme, or fragments or recombinant forms of any of these), a globulin protein (e.g., bovine serum albumin), an amino acid, a peptide (e.g., a polypeptide or a protein, including modified forms thereof, such as glycosylated polypeptides or multimeric polypeptides), a polysaccharide (e.g., a cyclic polysaccharide), a nucleic acid (e.g., a nucleotide, DNA, a single stranded DNA, a single stranded RNA, and an oligonucleotide, including modified forms of any of these), a receptor, an enzyme, an aptamer, a nanoparticle, a microparticle, a sandwich assay reagent, a label (e.g., one or more fluorescent labels, colorimetric labels, quantum dots, nanoparticles, microparticles, barcodes, radio labels (e.g., RF labels or barcodes), avidin, biotin, tags, dyes, an enzyme that can optionally include one or more linking agents and/or one or more dyes, as well as combinations thereof), a catalyst (e.g., that reacts with one or more targets), a lipid (e.g., a glycosylated lipid), and/or an enzyme (e.g., that reacts with one or more targets, such as any described herein). The capture probe can optionally include one or more labels, e.g., any described herein. In particular embodiments, more than one capture probe, optionally with one or more linking agents, can be used to detect a target of interest.

Optionally, linking agents can be used be attach the capture probe to the surface. Exemplary linking agents include compounds including one or more first functional groups, a linker, and one or more second functional groups. In some embodiments, the first functional group allows for linking between a surface and the linker (e.g., by way of a covalent or a non-covalent bond), and the second functional group allows for linking between the linker and the agent (e.g., a capture probe, a binding agent, a label, or any agent described herein, and by way of a covalent or a non-covalent bond). Exemplary linkers include any useful linker, such as polyethylene glycol (e.g., $(CH_2CH_2O)_{mg}$, where mg is from 1 to 50), an alkylene group (e.g., an optionally substituted $C_{1-12}$ alkylene or alkynyl chain), a heteroalkylene group, a carbocyclic ring (e.g., an aromatic ring, such as a phenyl group), a polypeptide (e.g., a dipeptide, tripeptide, etc.), and/or a flexible arm, e.g., 2, 3, 4, 5, 6, 7, 8, 9, 10, 11, 12, 13, 14, or 15 carbon atoms. The first and second functional groups can include any useful chemical moiety, such as moieties from a click-chemistry reaction pair selected from the group consisting of a Huisgen 1,3-dipolar cycloaddition reaction between an alkynyl group and an azido group to form a triazole-containing linker; a Diels-Alder reaction between a diene having a 47 electron system (e.g., an optionally substituted 1,3-unsaturated compound, such as optionally substituted 1,3-butadiene, 1-methoxy-3-trimethylsilyloxy-1,3-butadiene, cyclopentadiene, cyclohexadiene, or furan) and a dienophile or heterodienophile having a 27 electron system (e.g., an optionally substituted alkenyl group or an optionally substituted alkynyl group); a ring opening reaction with a nucleophile and a strained heterocyclyl electrophile; and a splint ligation reaction with a phosphorothioate group and an iodo group; and a reductive amination reaction with an aldehyde group and an amino group Other exemplary linkers include BS3 ([bis(sulfosuccinimidyl)suberate]; BS3 is a homobifunctional N-hydroxysuccinimide ester that targets accessible primary amines, such as those present on proteins or antibodies), NHS/EDC (N-hydroxysuccinimide and N-ethyl-(dimethylaminopropyl)carbodiimide; NHS/EDC allows for the conjugation of primary amine groups with carboxyl groups), sulfo-EMCS ([N-e-maleimidocaproic acid]hydrazide; sulfo-EMCS are heterobifunctional reactive groups (maleimide and NHS-ester) that are reactive toward sulfhydryl and amino groups), hydrazide (most proteins contain exposed carbohydrates and hydrazide is a useful reagent for linking carboxyl groups to primary amines), and SATA (N-succinimidyl-S-acetylthioacetate; SATA is reactive towards amines and adds protected sulfhydryls groups).

In particular embodiments, the linking agent is a silanizing compound. Exemplary silanizing agents include silazane (e.g., hexamethyldisilazane (HMDS)), haloalkylsilane (e.g., methyltrichlorosilane, trichlorocyclohexylsilane, dichlorodimethylsilane, dichloroethylsilane, bromotrimethylsilane, or chlorotrimethylsilane), haloarylsilane (e.g., fluorotriphenylsilane), trialkylsilylsilane (e.g., chlorotris (trimethylsilyl)silane), and silanol (e.g., 2-(trimethylsilyl) ethanol). Other silanizing agents include an agent having the structure of $(R^L)_3SiR^M$ or $R^LSi(R^M)_3$ or $R^LSi(SiR^M)_3$ or $(R^L)_2R^MSi\text{-}L\text{-}SiR^M(R^L)_2$, where each of $R^L$ is, independently, H, optionally substituted alkyl, hydroxyl, hydroxyalkyl, halo, haloalkyl, alkoxy, or aryl; each of $R^M$ is, independently, a functional moiety, such as optionally substituted alkyl, haloalkyl, hydroxyalkyl, alkenyl, alkoxy, aryl, alkaryl, heterocyclyl, heteroaryl, cycloalkyl, alkcycloalkyl, amino, aminoalkyl, or amido; L is a linker, such as optionally substituted alkylene, alkyleneoxy, arylene, heteroalkylene, heteroalkyleneoxy, or —$N(R^{N1})$—, where $R^{N1}$ is H, optionally substituted alkyl, alkaryl, or aryl; and where one of $R^L$ and X can optionally combine to form an optionally substituted heterocyclyl.

Such silanizing compounds can be used to graft an agent onto a surface (e.g., a silicon dioxide surface, or any surface including reactive hydroxyl groups). Other exemplary linking agents include pairs of linking agents that allow for binding between two different components. For instance, biotin and streptavidin react with each other to form a non-covalent bond, and this pair can be used to bind particular components.

Test Samples

The present package can be used to test any useful test sample, such as blood (e.g., whole blood), plasma, serum, transdermal fluid, interstitial fluid, sweat, intraocular fluid, vitreous humor, cerebrospinal fluid, extracellular fluid, lacrimal fluid, tear fluid, sputum, saliva, mucus, etc., and any other bodily fluid. The test sample can include any useful sample, such as a microorganism, a virus, a bacterium, a fungus, a parasite, a helminth, a protozoon, a cell, tissue, a fluid, a swab, a biological sample (e.g., blood, serum, plasma, saliva, etc.), an environmental sample, an agricultural sample, etc.

The sample can be obtained from any useful source, such as a subject (e.g., a human or non-human animal), a plant (e.g., an exudate or plant tissue, for any useful testing, such as for genomic and/or pathogen testing), an environment (e.g., a soil, air, and/or water sample), a chemical material, a biological material, or a manufactured product (e.g., such as a food or drug product).

Chambers, Including Recesses and Microchannels

The present package (e.g., lid, intermediate layer, etc.) can include one or more chambers, which can be configured to substantially enclose a fluid or a substance. Such chambers can include one or more inlets, outlets, fluidic opening (e.g., vias), fluidic barriers, or any other structure to allow for fluidic communication between one or more chambers, sample ports, vents, etc. Exemplary chambers include a channel, a reservoir, etc., having any useful geometry or dimension.

The chambers can be designated for a particular use. Particular uses for such chambers include a sample chamber for receiving and/or storing a test sample, an incubation chamber for incubating a test sample (e.g., to amplify one or more targets and optionally containing media and/or host cells for such amplification), a reagent chamber containing one or more reagents for detecting one or more targets, a sterilization chamber containing one or more reagents to sterilize or disinfect the test sample (e.g., containing one or more sterilization agents, as described herein), an assay chamber for conducting one or more assays to detect one or more targets (e.g., an assay chamber containing a capillary bed for a lateral flow assay), and/or a waste chamber for storing one or more by-products of the assay. Each of these chambers can be interconnected by a valve and/or a channel that can optionally include such a valve in its fluidic path.

EXAMPLES

Example 1: Biocompatible Microfluidic Packaging Method

A biocompatible packaging method has been developed that achieves a robust fluid seal for delivery of fluids and/or target antigens to a device (e.g., a sensor). This packaging method is low-temperature, which preserves the conformation of the biological capture layers (e.g., capture layers including antibodies, antibody fragments, nucleic acids such as DNA, peptides, or other immunologically active molecules). In part, the method employs functionalized plastics and monomers, which have an excess of thiols, maleimides, amines, epoxides, or succinimidyl esters to create an orthogonal click-chemistry. In particular embodiments, low-temperature bonding (e.g., about 37° C.) for 5-15 minutes is sufficient for bonding the structures together. This encapsulation method is superior to PDMS based packaging due to the improved seal between the substrate (e.g., the device and/or cradle) and the lid to form the package. Features can be patterned in any structure (e.g., device, cradle, and/or lid) using common techniques such as lithography, laser processing, spin casting, injection molding, and die cutting. Additional details are provided herein.

Example 2: Microfluidic Package Including a Polycarbonate Cradle

An exemplary microfluidic package can include a polycarbonate cradle, which houses a device having a silicon dioxide surface. Then, a lid is configured to bond to a portion of the cradle and/or device. Each surface and structure can be modified to provide any useful bonding surface, as described below.

The device surface (e.g., a $SiO_2$ surface) can be treated or patterned with a linking agent (e.g., an organosilane having a reactive group, such as an epoxide reactive group present on epoxysilane). Then, the reactive group of the linking agent can be reacted with an agent to create a further reactive group. As seen in FIG. 9A, the epoxide reactive group can be reacted with an amine, thereby providing an amino reactive group on the bonding surface of the device. As seen in FIG. 9B, reaction with a thiol provides a thioalkoxy reactive group on the bonding surface of the device. The device surface can be provided with any useful surface concentration of the epoxide reactive group to create an excess of amino or thioalkoxy reactive groups.

The reactive groups present on the device surface can be employed in any useful manner. In one instance, the amino or thioalkoxy reactive groups of FIG. 9A-9B are employed to attach antibodies or other immunological capture probes (e.g., on an active area of a device) for biological detection applications.

Optionally, other portions of the device can be surface-modified to provide an inactive or inert surface. In one non-limiting instance, another linking agent (e.g., a second organosilane) can be patterned upon the device surface to reduce non-specific binding while providing micron-level resolution patterning. The linking agent can include a terminal protecting group (e.g., a chemical moiety that reduces non-specific binding of the target analyte, such as aryl groups or poly(ethylene glycol) groups). Exemplary approaches for providing protected surfaces include selective addition of a linking agent or selective removal of a linking agent.

Selective addition of a linking agent can include the steps of patterning a surface with a first linking agent to provide a patterned surface having accessible reactive groups and then reacting the remaining surface with a second linking agent having a terminal protecting group. Exemplary steps include the following: spin on photoresist on a surface of the device; expose through a mask to pattern the photoresist; develop the photoresist to open the desired reaction sites for the first linking agent (e.g., an epoxysilane having an epoxide reactive group); deposit the first linking agent on the opened reaction sites; remove the photoresist to provide unreacted sites on the surface of the device; and flood react the unreacted sites with a second linking agent (e.g., phenyltrichlorosilane (PTCS) in toluene, thereby providing a phenyl protecting group on the surface; or 2-(methoxy (polyethyleneoxy)$_{21-24}$propyl)trimethoxysilane (MPEOTCS) in methanol, thereby providing a methoxy-terminated PEO or PEG protecting group on the surface).

Selective removal of a linking agent can include the steps of patterning a surface with a first linking agent having a terminal protecting group and then reacting the remaining surface with a second linking agent having a reactive group. Exemplary steps include the following: flood react a surface of the device with a first linking agent having a protecting group (e.g., PTCS or MPEOTCS); spin on photoresist on the modified surface; expose through a mask to pattern the photoresist; develop the photoresist to open the desired removal sites of the first linking agent; plasma etch the structure to remove the first linking agent from the removal sites; and deposit a second linking agent (e.g., an epoxysilane having an epoxide reactive group) on the etched sites.

Other useful modifications and steps can be included to provide selective removal and patterning of the linking agent in either selective addition or removal of linking agents. Such methods can provide microscale patterning, which can be spot-reacted or flood-reacted with capture probes (e.g., biological agents for immunological capture) with effective background blocking. In one non-limiting instance, spotting the immunological capture probe greatly reduces material loss for more costly agents.

The patterned device can be used in conjunction with a cradle. In one instance, the cradle employs a polycarbonate (PC) material having a bonding surface including a reactive group. FIG. 10A provides an exemplary schematic for modifying a PC surface. As can be seen, the surface of the PC (X-A) cradle can be modified using hexamethylene diamine (HMDA, X-B) to create a polymer (X-C) having an excess of amines on the surface. In some instances, the top surface of the polycarbonate does not undergo further machining in order to maintain a smooth bonding surface.

Next, the amino reactive groups on PC surface are converted to other reactive groups. As seen in FIG. 10A, the amino reactive groups on the PC can be converted to a maleimido reactive groups (e.g., using any useful agent, such as N-methoxycarbonyl maleimide (X-D) under basic conditions). As seen in FIG. 10B, the amino reactive group can be converted to a carbamido reactive group (e.g., using any useful agent, such as di(1H-imidazol-1-yl)methanone (X-F)). Functionalized PC (e.g., compounds X-E or X-G) now includes a bonding surface having reactive groups (e.g., selected to react with another reactive group present on another surface of the microfluidic package, such as a surface of the device and/or the lid).

Any useful agent(s) can be employed to install a linker and a reactive group on the cradle. In one instance, as seen in FIG. 10A-10B, two steps are employed to first install a linker (e.g., a $C_6$ alkylene linker) and then to install a reactive group (e.g., an imido group or a carbamido reactive group). In another instance, a single step can be employed by using a linking agent having the desired linker and desired reactive group to be provided on the bonding surface (e.g., use of a N-(4-aminophenyl)maleimide linking agent to provide, in one step, an amino group to react with the polymer surface, a phenylene linker, and an imido reactive group disposed on the bonding surface). Additional details for modifying and characterizing surfaces are described in, e.g., VanDelinder V et al., "Simple, benign, aqueous-based amination of polycarbonate surfaces, *ACS Appl. Mater. Interfaces* 2015; 7:5643-9, which is incorporated herein by reference in its entirety.

The lid can include any useful structure (e.g., polymeric structure). In particular embodiments, the lid includes a recess (e.g., a microchannel) disposed above the active area of the device. Upon assembling the lid with the device and cradle, the assembled package provides a sealed compartment in fluidic communication with the device.

The lid can be fabricated with any useful polymer. In one instance, the lid can be fabricated using a UV-curable thiol-ene based polymer including two monomers: one with thiol functional groups (e.g., $R^1$—SH in which $R^1$ is an organic moiety, e.g., optionally substituted alkyl or aryl) and the other with allyl functional groups (e.g., $R^2$—($CH_2$—CH═$CH_2$) in which $R^2$ is an organic moiety, e.g., optionally substituted alkyl, alkoxy, or aryl). An optional epoxy monomer can also be included. Such polymers are termed off-stoichiometry thiol-ene (OSTE) or off-stoichiometric thiol-ene-epoxy (OSTE+) polymers, in which the ratio of the monomers can be tuned to adjust the Young's modulus and glass transition temperature (Tg). In addition, one or more photoinitiators can be included to provide a UV-curable polymer.

Exemplary monomers having a thiol functional group include pentaerythritol tetrakis (2-mercaptoacetate) (PETMA), tris[2-(3-mercaptopropionyloxy) ethyl], and pentaerythritol tetrakis (3-mercaptopropionate) (PETMP); monomers having an allyl functional group include 1,3,5-triallyl-1,3,5-triazine-2,4,6 (1H,3H,5H)-trione (TATATO) and tetraallyloxyethane; monomers having an epoxide functional group include bisphenol A diglycidyl ether (BADGE) and 1-allyloxy-2,3-epoxypropane, allyl 2,3-epoxypropyl ether (AGE); and photoinitiators include Lucirin® TPO-L (ethyl-2,4,6-trimethylbenzoylphenylphosphinate) and Irgacure® 184 (1-hydroxy-cyclohexyl-phenyl-ketone). Additional monomers and photoinitiators include Ostemer™ 322, Ostemer™ 324, Ostemer™ 325, and Ostemer™ R Lithio (Mercene Labs AB, Stockholm, Sweden). Further exemplary polymers and monomers include those described in U.S. Pat. Nos. 8,927,664 and 9,523,019, each of which is incorporated herein by reference in its entirety.

FIG. 3A shows an exemplary lid 320 (e.g., formed from OSTE) including a microchannel 310. The lid can be directly bonded to the device 360 and cradle 350 in a single step at the wafer or die level. As seen in FIG. 3A, the surfaces are functionalized to provide different reactive groups and/or protecting groups. The lid 320 includes a bonding surface having thiol reactive groups, which can react with the bonding surface of the cradle 350 having maleimido reactive groups and/or the bonding surface of the device 360 having epoxide reactive groups. The device 360 can also include epoxide reactive groups from reacted linking agents (e.g., organosilanes), which can be further functionalized in any useful manner. Any unreacted organosilane of the device can be blocked using a chemical agent (e.g., molar excess of ethanolamine, amine compound, thiol compound, or similar blocking agent and/or stabilizer), which can be introduced into the structure after the lid is bonded.

When an organosilane patterning method is used, the lid can be bonded immediately after immobilizing one or more capture probes (e.g., on the active area of the device) as the background (e.g., on the inactive area of the device) is already blocked. As seen in FIG. 3A, a portion of the surface of the device can be reacted with a capture probe (e.g., proteins, nucleic acids, peptides, antibodies, etc., by way of —NHR, —SR, and —COOR reactive groups) in any useful manner (e.g., by way of photolithography and/or microspotting). Patterning with capture probes can occur prior to or after bonding the lid to the cradle and/or device.

To bring liquids to the device from the edges, an intermediate layer can be employed. FIG. 3B provides an exemplary intermediate layer 370 (e.g., formed from a thin sheet of polymethylmethacrylate (PMMA)), which can be modified to provide a bonding surface having one or more reactive groups. In FIG. 3B, imido reactive groups are chosen for the intermediate layer 370 to allow for a covalent bond-forming reaction with the thiol groups of the lid 320. Imido reactive groups can be installed in any useful manner, such as by reacting the acrylate group of PMMA with a diamine agent to provide a PMMA bonding surface having a $C_6$ alkylene linker and an amino reactive group (FIG. 3C). In another instance, imido reactive groups can be embedded in the acrylate monomers employed to form the PMMA layer.

In one instance, to prevent the reactive groups of the intermediate layer from reacting with target analytes in the sample, the imido reactive groups can be lithographically patterned using photoresist to block the functionalization of sites. Then, the intermediate layer can be attached to the upper surface of the lid in any useful manner (e.g., by applying low pressure (e.g., 5-20 psi) and at a low temperature (e.g., about 37° C.).

Fluidic connections to the package can be formed in any useful manner. In one instance, OSTE microfluidics connections can be embedded into the structures by treating the tubing with maleimide reactive groups, thereby forming a liquid tight seal. This configuration allows the fluidic connection points to be moved away from the active area of the device. Other configurations for fluidic connections may be employed with the package.

Example 3: Characteristics of Surface-Modified Polynorbornene

An exemplary polymer includes polynorbornene, which can be used to form the lid, cradle, device, and/or intermediate layer. Polynorbornene can be modified to provide any useful reactive moiety.

In one instance, we modified the surface of polynorbornene after synthesis by way of ring-opening metathesis polymerization (ROMP). The surface was modified with a thiol compound (FIG. 11A) via UV generated radicals, such that the polymer surface is functionalized with a functional group suitable for forming bonds by way of click chemistry. The resultant polymer can be an amino-modified polymer (e.g., polymer XI-C). These surface-presenting reactive groups were reacted with applied molecules for click-bonding to a variety of surfaces. The glass transition temperature (Tg) of the polymer was about 37° C., thereby allowing a conformal bond to be formed without damaging capture probes (e.g., provided as biological layers) disposed on a surface of a device and/or lid.

Any useful experimental setup can be employed to install reactive groups on the polymer's surface. In one instance, the setup includes solution-based functionalization of a polynorbornene structure, in which the solution includes a linking agent (e.g., including a first reactive group, a linker, and a second reactive group, such as a first reactive group including a thiol and a second reactive group including an amino) and an optional curing agent or initiator (e.g., a photoinitiator) (FIG. 11B). If a photoinitiator is used, then a light source (e.g., a UV lamp) can be employed with the setup.

The resultant polynorbornene structure was characterized by differential scanning calorimetry (DSC) and dynamic mechanical analysis (DMA) (FIG. 12A-12B). DSC was employed to determine Tg, in which this Tg can determine the bonding temperature. A lower bonding temperature can be critical to maintaining the biological activity of some capture probes. Thus, lower Tg generally correlates with lower bonding temperatures and with enhanced retention of biological activity of some capture probes. FIG. 12A shows a typical thermal response of polynorbornene to determine the Tg (about 39° C.), which is just above the physiological temperature at which most capture probes are stable. Multiple batches (n=3) have been tested to verify the synthesis process.

FIG. 12B shows the mechanical properties of functionalized polynorbornene, as determined by DMA. The observed elastic modulus was ~1200 MPa, which is comparable to other materials used in microfluidic packaging. Six runs were performed, and the average modulus was about 1172.7 MPa.

Surface characterization and chemical bond analyses can be conducted to ensure batch consistency. FIG. 13A-13B shows X-ray photoelectron spectroscopy (XPS) characterization of the surface of functionalized polynorbornene. XPS results show the presence nitrogen and sulfur on the surface of polynorbornene for each UV exposure time indicating the deposition of the linking agent (amine terminated thiol) at the surface (FIG. 13A). In addition, oxygen concentrations increased over time, indicating a degree of photo-oxidation of the double bonds (FIG. 13B).

Example 4: Microfluidic Burst Testing

A fluidic seal was formed between two bonding surfaces, and then tested until failure. In particular, the burst pressure of a fluidic channel validated the use of surface functionalization to provide a seal between the channel and an oxide bearing substrate. In this test, a polynorbornene microfluidic lid was functionalized with an aminated thiol (thereby providing a thiol reactive group) and then bonded to a succinimidyl reactive group present on a bonding surface of a N-hydroxysuccinimide (NHS) silane-coated silicon wafer. Fluidic connections were made with a laminate fluidic connector, and water was pumped into the microfluidic chip at 1 ml/min until a burst/leak was observed. The current lid failed at about 35 psi (FIG. 14).

Other Embodiments

All publications, patents, and patent applications, including U.S. Provisional Application 62/288,731, filed Jan. 29, 2016, mentioned in this specification are incorporated herein by reference to the same extent as if each independent publication or patent application was specifically and individually indicated to be incorporated by reference.

While the invention has been described in connection with specific embodiments thereof, it will be understood that it is capable of further modifications and this application is intended to cover any variations, uses, or adaptations of the invention following, in general, the principles of the invention and including such departures from the present disclosure that come within known or customary practice within the art to which the invention pertains and may be applied to the essential features hereinbefore set forth, and follows in the scope of the claims.

Other embodiments are within the claims.

The invention claimed is:

1. A method of making an encapsulated microfluidic package, the method comprising:

functionalizing a portion of a device to provide a first bonding surface comprising a first reactive group, wherein the device comprises an active area and an inactive area, and wherein the active area comprises biological or chemical capture probes;

functionalizing a lid to provide a second bonding surface comprising a second reactive group, wherein the lid comprises a recess, an upper surface, and the second bonding surface disposed on a lower surface of the lid, wherein the recess is configured to be disposed above the active area, and wherein the second reactive group is configured to react with the first reactive group; and attaching the second bonding surface of the lid to the first bonding surface of the device, thereby forming a fluidic seal, wherein the fluidic seal results from a reaction between the first and second reactive groups and wherein the first fluidic seal is formed in the presence of the biological or chemical capture probes.

2. The method of claim 1, further comprising, prior to the attaching step:

functionalizing the inactive area of the device to provide a protected surface comprising a protecting group.

3. The method of claim 1, wherein the second reactive group comprises at least one of polynorbornene, off-stoichiometry thiol-ene, or off-stoichiometry thiol-ene-epoxy.

4. The method of claim 3, wherein the lid is formed of a polymer, and further wherein functionalizing the lid comprises functionalizing the polymer with the second reactive group.

5. The method of claim 1, wherein the second reactive group comprises at least one of an amino group or a thio group.

6. The method of claim 5, wherein the first reactive group comprises at least one of an amido group, an imido group, or a carbamido group.

7. The method of claim 1, wherein the biological or chemical capture probes comprise at least one of an antibody, an aptamer, a nucleic acid, a protein, a receptor, and/or an enzyme, or fragments thereof.

8. A method of making an encapsulated microfluidic package, the method comprising:

attaching a device to a cradle, wherein the device comprises an active area and an inactive area, and wherein the active area comprises biological or chemical capture probes;

functionalizing a portion of the cradle to provide a first bonding surface comprising a first reactive group;

functionalizing a lid to provide a second bonding surface comprising a second reactive group, wherein the lid comprises a recess, an upper surface, and the second bonding surface disposed on a lower surface of the lid, wherein the recess is configured to be disposed above the active area, and wherein the second reactive group is configured to react with the first reactive group; and attaching the second bonding surface of the lid to the first bonding surface of the cradle, thereby forming a fluidic seal, wherein the fluidic seal results from a reaction between the first and second reactive groups and wherein the fluidic seal is formed in the presence of the biological or chemical capture probes.

9. The method of claim 8, further comprising:

functionalizing a portion of a device to provide a third bonding surface comprising a third reactive group, wherein the third reactive group is configured to react with the second reactive group; and/or functionalizing a portion of the inactive area of the device to provide a protected surface comprising a protecting group.

10. The method of claim 8, wherein the second reactive group comprises at least one of polynorbornene, off-stoichiometry thiol-ene, or off-stoichiometry thiol-ene-epoxy.

11. The method of claim 10, wherein the lid is formed of a polymer, and further wherein functionalizing the lid comprises functionalizing the polymer with the second reactive group.

12. The method of claim 8, wherein the second reactive group comprises at least one of an amino group or a thio group.

13. The method of claim 12, wherein the first reactive group comprises at least one of an amido group, an imido group, or a carbamido group.

14. The method of claim 8, wherein the biological or chemical capture probes comprise at least one of an antibody, an aptamer, a nucleic acid, a protein, a receptor, and/or an enzyme, or fragments thereof.

15. A method of making an encapsulated microfluidic package, the method comprising:

forming at least two pillars on an inactive area of a device, wherein the at least two pillars surround an active area of the device, and further wherein the active area of the device comprises biological or chemical capture probes;

functionalizing a portion of each of the at least two pillars to provide a first bonding surface including a first reactive group;

functionalizing a cover and/or a lid to provide a second bonding surface comprising a second reactive group, wherein the second reactive group is configured to react with the first reactive group; and attaching the second bonding surface of the cover to the first bonding surface of the pillar in the presence of the biological or chemical capture probes, thereby providing a lid having a recess disposed above the active area and forming a fluidic seal, wherein the fluidic seal results from a reaction between the first and second reactive groups.

16. The method of claim 15, wherein the second reactive group comprises at least one of polynorbornene, off-stoichiometry thiol-ene, or off-stoichiometry thiol-ene-epoxy.

17. The method of claim 16, wherein the cover and/or lid is formed of a polymer, and further wherein functionalizing the lid comprises functionalizing the polymer with the second reactive group.

18. The method of claim 15, wherein the second reactive group comprises at least one of an amino group or a thio group.

19. The method of claim 18, wherein the first reactive group comprises at least one of an amido group, an imido group, or a carbamido group.

20. The method of claim 15, wherein the biological or chemical capture probes comprise at least one of an antibody, an aptamer, a nucleic acid, a protein, a receptor, and/or an enzyme, or fragments thereof.

* * * * *